US006347524B1

(12) United States Patent
Barrash et al.

(10) Patent No.: US 6,347,524 B1
(45) Date of Patent: Feb. 19, 2002

(54) APPARATUS USING STIRLING COOLER SYSTEM AND METHODS OF USE

(75) Inventors: Marshall J. Barrash; Arthur G. Rudick, both of Atlanta; Lawrence Blair Ziesel, Woodstock, all of GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/724,875

(22) Filed: Nov. 28, 2000

Related U.S. Application Data

(62) Division of application No. 09/401,164, filed on Sep. 22, 1999, now Pat. No. 6,272,867.

(51) Int. Cl.[7] ..... F25B 9/00; F25D 17/02
(52) U.S. Cl. ..... 62/6; 62/99
(58) Field of Search ..... 62/6, 434, 99

(56) References Cited

U.S. PATENT DOCUMENTS

| | | | | |
|---|---|---|---|---|
| 1,815,170 | A | 7/1931 | Summers | |
| 2,095,008 | A | 10/1937 | Philipp | 62/115 |
| 2,342,299 | A | 2/1944 | Peet | 225/40 |
| 2,470,547 | A | 5/1949 | Childers | 62/103 |
| 2,512,545 | A | 6/1950 | Hazard | 62/125 |
| 2,660,037 | A | 11/1953 | Coopers | 62/116 |
| 2,672,029 | A | 3/1954 | Saunders | 62/117.2 |
| 2,885,142 | A | 5/1959 | Eberhart | 230/117 |
| 2,961,082 | A | 11/1960 | Hanson et al. | 194/13 |
| 3,004,408 | A | 10/1961 | Dros et al. | 62/419 |

(List continued on next page.)

FOREIGN PATENT DOCUMENTS

| | | |
|---|---|---|
| CH | 233-266 | 7/1944 |
| EP | 0 065 995 | 12/1982 |
| EP | 0 935 063 | 8/1999 |
| FR | 2-609-789 | 7/1988 |
| JP | 64-36468 | 2/1989 |
| JP | 01 269874 | 10/1989 |
| JP | 2-217758 | 8/1990 |
| JP | 7-180921 | 7/1995 |
| JP | WO 98/34076 | 8/1998 |
| JP | 0 935 063 A2 | 8/1999 |

OTHER PUBLICATIONS

Lyn Bowman, "A Technical Introduction to Free–Piston Stirling Cycle Machines: Engines, Coolers, and Heat Pumps," May, 1993, pp. 1–7.

B.D. Mennink et al., "Development of an Improved Stirling Cooler for Vacuum Super Insulated Fridges with Thermal Store and Photovoltaic Power Source for Industrialized and Developing Countries," International Institute of Refrigeration Conference, May 10–13, pp. 1–9.

D.M. Berchowitz et al., "Recent Advances in Stirling Cycle Refrigeration," Aug. 20–25, 1995, 8 pages.

(List continued on next page.)

*Primary Examiner*—William C. Doerrler
(74) *Attorney, Agent, or Firm*—Sutherland Asbill & Brennan LLP

(57) ABSTRACT

There is disclosed novel apparatus for use as beverage container vending machines, beverage dispensers, transportable beverage container dispensers and glass door merchandisers, all cooled by Stirling coolers. The apparatus includes an insulated enclosure and a Stirling cooler having a cold portion. A plate or coil made from a heat-conducting material disposed within the insulated enclosure is connected in heat exchange relationship with the cold portion of the Stirling cooler. Heat transfer fluids, heat pipes and direct contact are different methods used to transfer heat from the plate to the cold portion of the Stirling cooler. The cooled plate or coil is used to cool a container or a fluid that is, in turn, used to cool either a container or a fluid. Methods of chilling containers and fluids are also disclosed.

9 Claims, 15 Drawing Sheets

U.S. PATENT DOCUMENTS

| | | | | |
|---|---|---|---|---|
| 3,206,943 | A | 9/1965 | Rice et al. | |
| 3,230,733 | A | 1/1966 | Rutishauser et al. | 62/256 |
| 3,302,429 | A | 2/1967 | Byrd | 62/514 |
| 3,712,078 | A | 1/1973 | Maynard et al. | 62/448 |
| 3,853,437 | A | 12/1974 | Horn et al. | 418/61 |
| 3,997,028 | A | 12/1976 | Lopez | 186/1 |
| 4,037,081 | A | 7/1977 | Aldridge et al. | 219/387 |
| 4,037,650 | A | 7/1977 | Randall | 165/29 |
| 4,138,855 | A | 2/1979 | Jahan et al. | 62/112 |
| 4,176,526 | A | 12/1979 | Missimer | 62/278 |
| 4,176,529 | A | 12/1979 | Stierlin et al. | 62/490 |
| 4,259,844 | A | 4/1981 | Sarcia et al. | 62/6 |
| 4,275,705 | A | 6/1981 | Schaus et al. | 126/110 R |
| 4,306,613 | A | 12/1981 | Christopher | 165/32 |
| 4,377,074 | A | 3/1983 | Jardine | 62/183 |
| 4,383,421 | A | 5/1983 | Quesnoit | 62/333 |
| 4,416,122 | A | 11/1983 | Johnson | 62/448 |
| 4,471,633 | A | 9/1984 | Tinsler | 62/295 |
| 4,480,445 | A | 11/1984 | Goldstein | 62/434 |
| 4,490,991 | A | 1/1985 | Griffin | 62/279 |
| 4,539,737 | A | 9/1985 | Kerpers et al. | 29/423 |
| 4,554,797 | A | 11/1985 | Goldstein | 62/434 |
| 4,558,570 | A | 12/1985 | Shtrikman et al. | 62/6 |
| 4,694,650 | A | 9/1987 | Vincent | 60/520 |
| 4,726,193 | A | 2/1988 | Burke et al. | 62/3 |
| 4,759,190 | A | 7/1988 | Trachtenberg et al. | 62/3 |
| 4,783,968 | A | 11/1988 | Highham et al. | 62/6 |
| 4,811,563 | A | 3/1989 | Furuishi et al. | 60/517 |
| 4,823,554 | A | 4/1989 | Trachtenberg et al. | 62/3 |
| 4,827,733 | A | 5/1989 | Dinh | 62/305 |
| 4,827,735 | A | 5/1989 | Foley | 62/430 |
| 4,831,831 | A | 5/1989 | Carter et al. | 62/59 |
| 4,843,826 | A | 7/1989 | Malakar | 62/6 |
| 4,882,911 | A | 11/1989 | Immel | 62/288 |
| 4,922,722 | A | 5/1990 | Kazumoto et al. | 62/6 |
| 4,941,527 | A | 7/1990 | Toth et al. | 164/47 |
| 4,949,554 | A | 8/1990 | Branz et al. | 62/248 |
| 4,964,279 | A | 10/1990 | Osborne et al. | 62/59 |
| 4,977,754 | A | 12/1990 | Upton et al. | 62/248 |
| 4,996,841 | A | 3/1991 | Meijer et al. | 60/525 |
| 5,069,273 | A | 12/1991 | O'Hearne | 165/12 |
| 5,076,351 | A | 12/1991 | Munekawa et al. | 165/104.21 |
| 5,094,083 | A | 3/1992 | Horn et al. | 62/6 |
| 5,142,872 | A | 9/1992 | Tipton et al. | 62/6 |
| 5,228,299 | A | 7/1993 | Harrington et al. | 60/55.5 |
| 5,259,198 | A | 11/1993 | Viegas et al. | 62/7 |
| 5,259,214 | A | 11/1993 | Nagatomo et al. | 62/324.1 |
| 5,284,022 | A | 2/1994 | Chung | 62/6 |
| 5,303,769 | A | 4/1994 | Hoegberg | 165/108 |
| 5,305,825 | A | 4/1994 | Roehrich et al. | 165/64 |
| 5,309,986 | A | 5/1994 | Itoh | 165/104.26 |
| 5,311,927 | A | 5/1994 | Taylor et al. | 165/64 |
| 5,333,460 | A | 8/1994 | Lewis et al. | 62/6 |
| 5,341,653 | A | 8/1994 | Tippmann et al. | 62/288 |
| 5,347,827 | A | 9/1994 | Rudick et al. | 62/440 |
| 5,402,654 | A | 4/1995 | Rudick et al. | 62/448 |
| 5,406,805 | A | 4/1995 | Radermacher et al. | 62/81 |
| 5,417,079 | A | 5/1995 | Rudick et al. | 62/253 |
| 5,417,081 | A | 5/1995 | Rudick et al. | 62/440 |
| 5,438,848 | A | 8/1995 | Kim et al. | 62/342 |
| 5,440,894 | A | 8/1995 | Schaeffer et al. | 62/203 |
| 5,493,874 | A | 2/1996 | Landgrebe | 62/457.2 |
| 5,496,153 | A | 3/1996 | Redlich | 417/212 |
| 5,524,453 | A | 6/1996 | James | 62/434 |
| 5,525,845 | A | 6/1996 | Beale et al. | 310/30 |
| 5,537,820 | A | 7/1996 | Beale et al. | 60/517 |
| 5,542,257 | A | 8/1996 | Mattern-Klosson et al. | 62/55.5 |
| 5,551,250 | A | 9/1996 | Yingst et al. | 62/234 |
| 5,596,875 | A | 1/1997 | Berry et al. | 62/6 |
| 5,638,684 | A | 6/1997 | Siegel et al. | 62/6 |
| 5,642,622 | A * | 7/1997 | Berchowitz et al. | 62/6 |
| 5,645,407 | A | 7/1997 | Kralick et al. | 417/383 |
| 5,647,217 | A | 7/1997 | Penswick et al. | 62/6 |
| 5,647,225 | A | 7/1997 | Fischer et al. | 62/434 |
| 5,649,431 | A | 7/1997 | Schroeder, Jr. | 62/434 |
| 5,655,376 | A | 8/1997 | Price | 62/6 |
| 5,678,409 | A | 10/1997 | Price | 62/6 |
| 5,678,421 | A | 10/1997 | Maynard et al. | 62/407 |
| 5,724,833 | A | 3/1998 | Devers | 62/625 |
| 5,735,131 | A * | 4/1998 | Lambright et al. | 62/99 |
| 5,782,106 | A | 7/1998 | Park | 62/452 |
| 5,794,444 | A | 8/1998 | Hofbauer et al. | 60/517 |
| 5,878,581 | A | 3/1999 | DeFrances et al. | 62/50.2 |
| 5,881,566 | A | 3/1999 | Shacklock et al. | 62/277 |
| 5,895,033 | A | 4/1999 | Ross et al. | 267/161 |
| 5,906,290 | A | 5/1999 | Haberkorn | 220/505 |
| 5,920,133 | A | 7/1999 | Penswick et al. | 310/17 |
| 5,927,079 | A | 7/1999 | Sekiya et al. | 62/6 |
| 5,927,080 | A | 7/1999 | Lee | 62/6 |
| 6,003,319 | A | 12/1999 | Gilley et al. | 62/3.7 |
| 6,023,937 | A | 2/2000 | Rodrigues | 62/295 |
| 6,067,804 | A | 5/2000 | Moeykens et al. | 62/84 |
| 6,073,547 | A | 6/2000 | Westbooks, Jr. et al. | 99/468 |
| 6,079,481 | A | 6/2000 | Lowenstein et al. | 165/10 |
| 6,112,526 | A * | 9/2000 | Chase | 62/6 |
| 6,148,634 | A | 11/2000 | Sherwood | 62/434 |
| 6,158,499 | A | 12/2000 | Rhodes | 165/10 |
| 6,178,770 | B1 | 1/2001 | Bradley, Jr. et al. | 62/434 |

OTHER PUBLICATIONS

Kelly McDonald et al., "Stirling Refrigerator for Space Shuttle Experiments," Aug. 7–11, 1994; 6 pages.

Sunpower, Inc., "Introduction to Sunpower, Stirling Machines and Free–Piston Technology," Dec. , 1995, pp. 1–4.

D. M. Berchowitz et al., "Test Results for Stirling Cycle Cooled Domestic Refrigerators," Sep. 3–6, 1996, 9 pages.

Royal Vendors, Inc., "G–III All Purpose Vendor Operation and Service Manual," 9/96, pp. 1–67.

D. M. Berchowitz et al., "Stirling Coolers for Solar Refrigerators," 10 pages.

Michael K. Ewert et al., "Experimental Evaluation of a Solar PV Refrigerator with Thermoelectric, Stirling, and Vapor Compression heat Pumps," 7 pages.

D.M. Berchowitz, Ph.D., "Maximized Performance of Stirling Cycle Refrigerators," 8 pages.

David Bergeron, "Heat Pump Technology Recommendation for a Terrestrial Battery–Free solar Refrigerator," Sep., 1998, pp. 1–25.

Seon–Young Kim, et al., "Application of Stirling Cooler to Refrigeration," pp. 1023–1026.

R. H. Green, et al., "The Design and Testing of a Stirling Cycle Domestic Freezer," pp. 153–161.

Abstract of Japanese Publication No. 02302563 (Toshiba Corp.) Dec. 14, 1990.

Abstract of Japanese Publication No. 03036468 (Toshiba Corp.) Feb. 18, 1991.

Abstract of Japanese Publication No. 03294753 (Toshiba Corp.) Dec. 25, 1991.

Abstract of Japanese Publication No. 04217758 (Toshiba Corp.) Aug. 7, 1992.

Abstract of Japanese Publication No. 05203273 (Toshiba Corp.) Aug. 10, 1993.

Abstract of Japanese Publication No. 05306846 (Toshiba Corp.) Nov. 19, 1993.
Abstract of Japanese Publication No. 07180921 (Toshiba Corp.) Jul. 18, 1995.
Abstract of Japanese Publication No. 08005179 (Toshiba Corp.) Jan. 12, 1996.
Abstract of Japanese Publication No. 08100958 (Toshiba Corp.) Apr. 16, 1996.
Abstract of Japanese Publication No. 08247563 (Toshiba Corp.) Sep. 27, 1996.

* cited by examiner

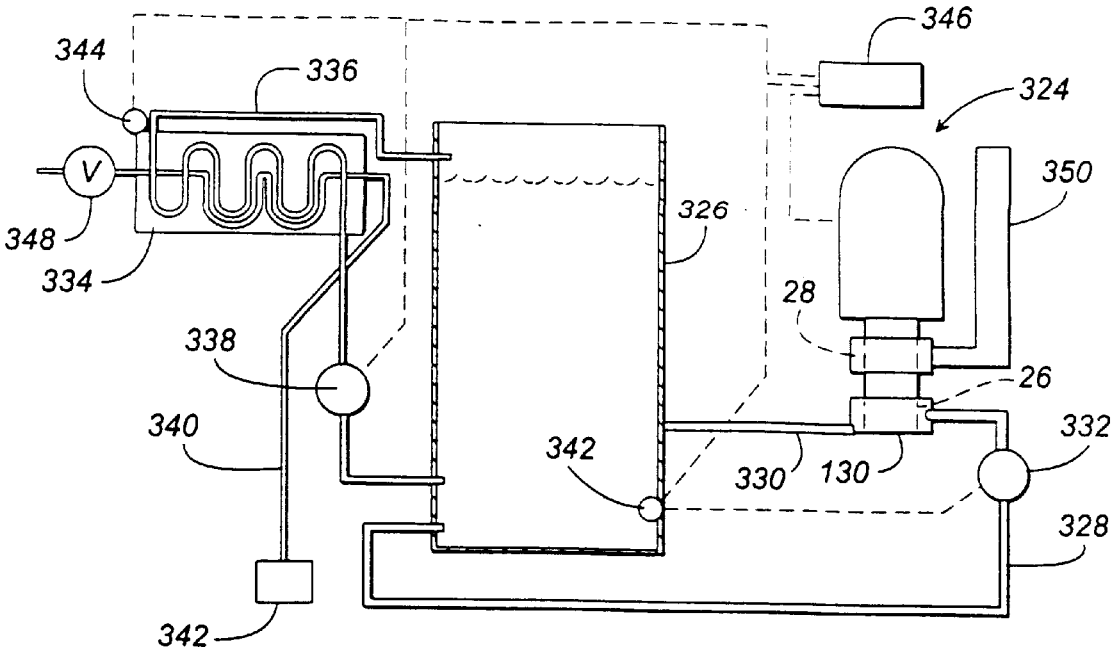
FIG. 16
FIG. 17
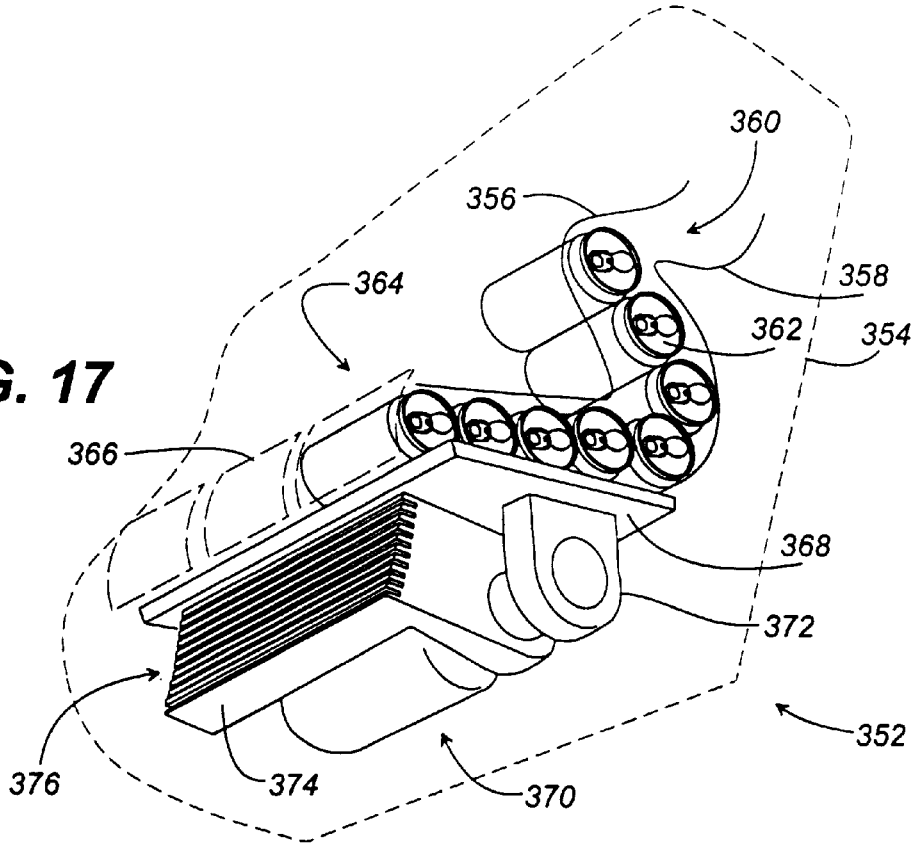

APPARATUS USING STIRLING COOLER SYSTEM AND METHODS OF USE

This application is a division of Ser. No. 09/401,164 filed Sep. 22, 1999 U.S. Pat. No. 6,272,867, issued Aug. 14, 2001.

FIELD OF INVENTION

The present invention relates generally to refrigeration systems, and, more specifically, to refrigeration systems that use a Stirling cooler as the mechanism for removing heat from a desired space. More particularly the present invention relates to refrigerated apparatus for vending or dispensing containers, for dispensing cold liquids and for chilling containers and the contents thereof.

BACKGROUND OF THE INVENTION

Refrigeration systems are prevalent in our everyday life. In the beverage industry, refrigeration systems are found in vending machines, glass door merchandisers ("GDMs") and dispensers. In the past, these units have kept beverages or containers containing a beverage cold using conventional vapor compression (Rankine cycle) refrigeration apparatus. In this cycle, the refrigerant in the vapor phase is compressed in a compressor, causing an increase in temperature. The hot, high pressure refrigerant is then circulated through a heat exchanger, called a condenser, where it is cooled by heat transfer to the surrounding environment. As a result of the heat transfer to the environment, the refrigerant condenses from a gas to a liquid. After leaving the condenser, the refrigerant passes through a throttling device where the pressure and temperature both are reduced. The cold refrigerant leaves the throttling device and enters a second heat exchanger, called an evaporator, located in the refrigerated space. Heat transfer in the evaporator causes the refrigerant to evaporate or change from a saturated mixture of liquid and vapor into a superheated vapor. The vapor leaving the evaporator is then drawn back into the compressor, and the cycle is repeated. A variation of the vapor compression cycle as outlined above is the transcritical carbon dioxide vapor compression cycle where the condenser is replaced with an ultra-high pressure gas cooler and phase change does not occur.

Stirling coolers have been known for decades. Briefly, a Stirling cycle cooler compresses and expands a gas (typically helium) to produce cooling. This gas shuttles back and forth through a regenerator bed to develop much larger temperature differentials than the simple compression and expansion process affords. A Stirling cooler uses a displacer to force the gas back and forth through the regenerator bed and a piston to compress and expand the gas. The regenerator bed is a porous element with a large thermal inertia. During operation, the regenerator bed develops a temperature gradient. One end of the device becomes hot and the other end becomes cold. David Bergeron, *Heat Pump Technology Recommendation for a Terrestrial Battery-Free Solar Refrigerator*, September 1998. Patents relating to Stirling coolers include U.S. Pat. Nos. 5,678,409; 5,647,217; 5,638,684; 5,596,875; and 4,922,722.

Stirling coolers are desirable because they are nonpolluting, are efficient and have very few moving parts. The use of Stirling coolers has been proposed for conventional refrigerators. See U.S. Pat. No. 5,438,848. However, it has been recognized that the integration of free-piston Stirling coolers into conventional refrigerated cabinets requires different techniques than conventional compressor systems. D. M. Berchowitz et al., *Test Results for Stirling Cycle Cooler Domestic Refrigerators*, Second International Conference. To date, the use of Stirling coolers in beverage vending machines, GDMs and dispensers is not known.

Therefore, a need exists for adapting Stirling cooler technology to conventional beverage vending machines, GDMs, dispensers and the like.

SUMMARY OF THE INVENTION

The present invention satisfies the above-described needs by providing novel applications of Stirling cooler technology to the beverage industry. A novel apparatus in accordance with the present invention comprises an insulated enclosure, the enclosure having an outside and an inside and at least two Stirling coolers disposed outside the enclosure. The Stirling coolers each having a hot portion and a cold portion and the Stirling coolers are spaced from each other. A heat-conducting member is provided for each Stirling cooler. A first portion of each heat-conducting member is connected in heat exchange relationship with the cold portion of each Stirling cooler. The heat-conducting member extending from the Stirling cooler through the insulated enclosure such that a second portion is inside the enclosure. A heat-conducting plate is connected in heat exchange relationship to at least one of the second portions of the heat-conducting member inside the enclosure.

In an alternate embodiment, the present invention comprises an insulated enclosure having a top and a first heat-conducting member having opposite ends. The first member extending through the top of the enclosure such that one end extends into the enclosure and the other end extends outside the enclosure. A first Stirling cooler is disposed outside the enclosure and has a hot portion and a cold portion. The cold portion of the first Stirling cooler is removably connected in heat exchange relationship adjacent the end of the first member extending outside the enclosure A first heat-conducting plate is disposed adjacent the top of the enclosure, the plate being connected in heat exchange relationship adjacent the end of the first member extending inside the enclosure, such that heat from air in the enclosure can flow from the air surrounding the first plate through the plate and the first member to the cold portion of the first Stirling cooler.

The present invention also comprises a method of cooling the inside of an insulated enclosure. The method comprises removably connecting in heat exchange relationship a cold portion of a first Stirling cooler to a first heat-conducting member extending from outside the enclosure to inside the enclosure, the first member being connected in heat exchange relationship to a plate disposed inside the enclosure.

Another embodiment of the present invention comprises an insulated enclosure having an inside, an outside and a top. A first Stirling cooler having a cold portion and a hot portion is disposed so that the cold portion of the first Stirling cooler extending through the enclosure such that the cold portion is disposed inside the enclosure and the hot portion is disposed outside the enclosure. A first plate disposed inside the enclosure and adjacent the top of the enclosure is connected in heat transfer relationship to the cold portion of the first Stirling cooler.

In an alternate embodiment, the present invention comprises a method of cooling the inside of an insulated enclosure having an inside, an outside and a top. The method comprises removably connecting in heat exchange relationship a cold portion of a Stirling cooler to a first heat-conducting plate disposed inside the enclosure and adjacent the top of the enclosure, the hot portion of the Stirling cooler being disposed outside the enclosure.

In still another disclosed embodiment, the present invention comprises a method of cooling the inside of an insulated enclosure having an inside, an outside and a top. The method comprises removably connecting in heat exchange relationship a cold portion of a Stirling cooler and a first heat-conducting plate disposed inside the enclosure adjacent the top of the enclosure. The hot portion of the Stirling cooler is disposed outside the enclosure.

Another embodiment of the present invention comprises a transportable apparatus comprising an insulated enclosure for containing a plurality of containers, the enclosure having an inside, an outside and a door for dispensing containers from the inside to the outside, the enclosure being mountable in a vehicle. A dispensing path is defined by a pair of spaced members, the dispensing path being for receiving a plurality of containers in stacked relationship and for dispensing them sequentially from the apparatus. A portion of the dispensing path adjacent the door is at least partially defined by a plate made of a heat transfer material, such that the containers in the dispensing path contact the plate before being dispensed through the door. A Stirling cooler is disposed outside the enclosure, the Stirling cooler having a hot portion and a cold portion, the Stirling cooler being powerable by the vehicle's electrical system. A heat-conducting member connects the plate to the cold portion of the Stirling cooler in heat transfer relationship.

In another embodiment, the present invention comprises contacting at least a portion of a container to be dispensed from an insulated enclosure with a heat-conducting plate before the container is dispensed from the enclosure, such that heat is transferred from the container to the plate, the plate being connected in heat transfer relationship to a cold portion of a Stirling cooler.

In still another embodiment, the present invention comprises contacting at least a portion of a container to be dispensed from an insulated enclosure disposed in a vehicle with a heat-conducting plate before the container is dispensed from the enclosure, such that heat is transferred from the container to the plate, the plate being connected in heat transfer relationship to a cold portion of a Stirling cooler, the Stirling cooler being powered by an electrical system from the vehicle.

In another embodiment, the present invention comprises an insulated enclosure having an outside and an inside and means disposed inside the enclosure for defining a path for receiving a plurality of containers in stacked relationship and for dispensing containers therefrom. Heat-conducting means are associated with the path means such that at least a portion of the containers stacked in the path contact the heat-conducting means before the containers are dispensed from the apparatus. A Stirling cooler is disposed outside the enclosure, the Stirling cooler having a hot portion and a cold portion. A means is provided for circulating a heat-conducting fluid from the cold portion of the Stirling cooler to the heat-conducting means and back to the cold portion such that the heat-conducting fluid undergoes heat exchange with the heat-conducting means and with the cold portion of the Stirling cooler.

In a further embodiment, the present invention comprises an insulated enclosure having an outside, an inside and an openable door for accessing containers stored inside the enclosure. At least one vertically oriented heat pipe is disposed inside the enclosure. At least one heat-conducting shelf is disposed inside the enclosure, the shelf being connected in heat exchange relationship to the heat pipe. At least one Stirling cooler having a hot portion and a cold portion is provided outside the enclosure. The cold portion of the Stirling cooler is connected in heat exchange relationship with the heat pipe.

In another embodiment, the present invention comprises a Stirling cooler having a hot portion and a cold portion. A fluid heat exchanger is disposed adjacent the cold portion of the Stirling cooler and in heat exchange relationship therewith. A fluid reservoir is provided for containing a heat transfer fluid, the fluid reservoir being connected to the fluid heat exchanger for fluid communication therewith. A pump is operative to circulate the heat transfer fluid from the fluid reservoir through the fluid heat exchanger and back. An inner flexible annular sleeve is provided for containing the heat transfer fluid and for receiving a container therein in heat exchange relationship therewith, the sleeve being connected to the fluid reservoir for fluid communication therewith. A pump is operative to circulate the heat transfer liquid in the fluid reservoir through the inner sleeve and back. An annular outer inflatable sleeve is disposed about the inner sleeve, such that when the outer sleeve is inflated, the inner sleeve is pressed into contact with a container received therein and when the outer sleeve is not inflated, the container can be removed from the inner sleeve. A pump is operatively associated with the outer sleeve to selectively inflate and deflate the outer sleeve.

In still another embodiment, the present invention comprises a Stirling cooler having a hot portion and a cold portion. A first fluid heat exchanger is disposed adjacent the cold portion of the Stirling cooler and in heat exchange relationship therewith. A fluid reservoir for containing a heat transfer fluid is connected to the first fluid heat exchanger for fluid communication therewith. A pump is operative to circulate the heat transfer fluid from the fluid reservoir through the first fluid heat exchanger and back. A second fluid heat exchanger is provided having a fluid inlet, a fluid outlet, a heat transfer fluid inlet and a heat transfer fluid outlet. The second heat exchanger is operative to transfer heat from a fluid flowing from the inlet to the outlet to a heat transfer fluid flowing from the heat transfer fluid inlet to the heat transfer fluid outlet. The fluid inlet is connectable to a source of fluid under pressure so that fluid can flow from the fluid inlet to the fluid outlet. A pump is operative to circulate the heat transfer fluid from the fluid reservoir to the second fluid heat exchanger and back.

In another embodiment, the present invention comprises circulating a heat transfer fluid from a fluid reservoir to a heat exchanger in heat exchange relationship with a cold portion of a Stirling cooler, such that the heat transfer fluid in the reservoir is at a desired temperature. A container containing a fluid to be chilled is positioned inside a flexible annular sleeve fillable with the heat transfer fluid from the reservoir. The sleeve is pushed into heat transfer contact with the container and the heat transfer fluid from the fluid reservoir is circulated through the sleeve and back, such that heat from the container and the contained fluid is transferred to the heat transfer fluid circulated through the sleeve. The sleeve is released from contact with the container and the container is removed from the sleeve.

In still another embodiment, the present invention comprises circulating a heat transfer fluid from a fluid reservoir to a heat exchanger in heat exchange relationship with a cold portion of a Stirling cooler, such that the heat transfer fluid in the reservoir is at a desired temperature. The heat transfer fluid in the fluid reservoir is circulated through a second heat exchanger and back. A fluid to be chilled is flowed through the second heat exchanger so that heat from the flowing fluid to be chilled is transferred to the heat transfer fluid circulated through the second heat exchanger.

In another embodiment, the present invention comprises an insulated enclosure having an outside and an inside and means disposed inside the enclosure for defining a path for receiving a plurality of containers in stacked relationship and for dispensing individual containers therefrom. A heat-conducting means is associated with the path means such that at least a portion of each container stacked in the path contacts the heat-conducting means before each container is dispensed from the path means. A Stirling cooler is disposed outside the enclosure, the Stirling cooler having a hot portion and a cold portion. At least one heat pipe is connected to the cold portion and to the heat-conducting means.

In a further embodiment, the present invention comprises an insulated enclosure having an outside and an inside and a door for accessing containers contained in the enclosure. At least one heat-conducting shelf is disposed inside the enclosure for supporting a plurality of containers thereon. A Stirling cooler having a hot portion and a cold portion is disposed outside the enclosure, such that the cold portion of the Stirling cooler extends into the enclosure. The cold portion of the Stirling cooler is connected to a heat-conducting shelf upon which containers can be placed. Alternately, the Stirling cooler is disposed outside the enclosure and one end of at least one heat pipe, or other heat-conducting material, is connected to the cold portion and the other end is connected to the heat-conducting shelf.

In yet another disclosed embodiment, the present invention comprises a fluid container containing a heat transfer fluid. The cold portion of the Stirling cooler is connected in heat exchange relationship to a first heat exchange member in contact with the heat transfer fluid in the container. A source of a fluid to be chilled is connected in fluid communication with a second heat exchange member in contact with the heat transfer fluid in the container.

In still another disclosed embodiment, the present invention comprises a Stirling cooler having a hot portion and a cold portion and a first heat exchanger in heat exchange relationship with the cold portion of the Stirling cooler and operative to remove heat from a heat transfer fluid in the first heat exchanger. The invention also comprises a fluid reservoir for containing a phase change fluid and a second heat exchanger disposed in the phase change fluid in the reservoir and in fluid communication with the heat transfer fluid in the first heat exchanger and operative to transfer heat between the phase change fluid and the heat transfer fluid in the second heat exchanger. A third heat exchanger is in fluid communication with the heat transfer fluid in the second heat exchanger and is operative to remove heat from a fluid to be chilled in heat transfer relationship with the third heat exchanger. A pump is operative to circulate the heat transfer fluid from the first heat exchanger to the second heat exchanger to the third heat exchanger and back.

In another disclosed embodiment, the present invention comprises removing heat from a heat transfer fluid in heat exchange relationship with a cold portion of a Stirling cooler and circulating the heat transfer fluid to a first heat exchanger disposed in a phase change fluid in a fluid reservoir and then through a second heat exchanger. The invention further comprises flowing a fluid to be chilled through the second heat exchanger so that heat from the flowing fluid to be chilled is transferred to the heat transfer fluid circulating through the first and second heat exchangers.

Accordingly, it is an object of the present invention to provide improved refrigerated apparatus used in the beverage industry.

Another object of the present invention is to provide an improved vending machine.

A further object of the present invention is to provide an improved GDM.

Still another object of the present invention is to provide an improved beverage dispenser.

Another object of the present invention is to provide an improved system for chilling containers and fluids.

Another object of the present invention is to provide vending machines, GDMs and dispensers that have reduced energy consumption.

Yet another object of the present invention is to provide vending machines, GDMs and dispensers using refrigeration systems that have improved reliability and serviceability.

These and other objects, features and advantages of the present invention will become apparent after a review of the following detailed description of the disclosed embodiments and the appended drawing and claims.

BRIEF DESCRIPTION OF THE DRAWING

FIG. 16 is a schematic view of a disclosed embodiment of a fluid chilling apparatus in accordance with the present invention.

FIG. 17 is a perspective view of a disclosed embodiment of a beverage container dispensing apparatus in accordance with the present invention with the casing for the apparatus shown in phantom.

DESCRIPTION OF THE DISCLOSED EMBODIMENTS

Figure 1:
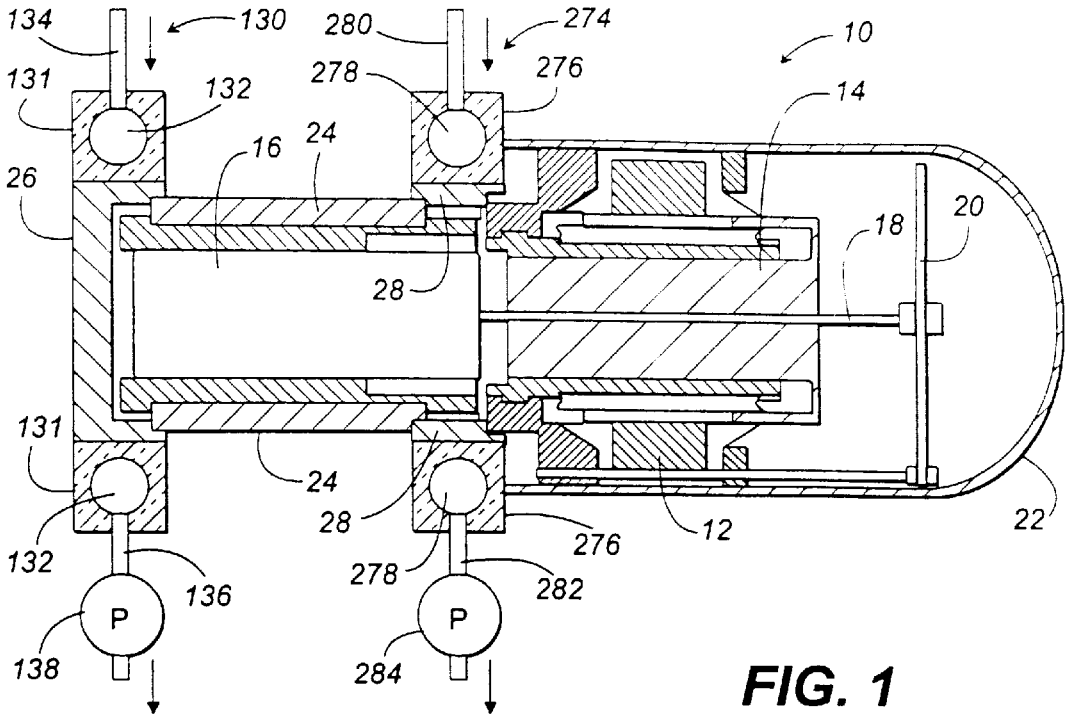
FIG. 1 is a cross-sectional view of a prior art free-piston Stirling cooler useful in the present invention.

The present invention utilizes a Stirling cooler. Stirling coolers are well known to those skilled in the art. Stirling coolers useful in the present invention are commercially available from Sunpower, Inc. of Athens, Ohio. Other Stirling coolers useful in the present invention are shown in U.S. Pat. Nos. 5,678,409; 5,647,217; 5,638,684; 5,596,875; 5,438,848 and 4,922,722, the disclosures of which are incorporated herein by reference. A particularly useful type of Stirling cooler is the free-piston Stirling cooler.

With reference to the drawing in which like numbers indicate like elements throughout the several views, it can be seen that there is a free-piston Stirling cooler 10 (FIG. 1) comprising a linear electric motor 12, a free piston 14, a displacer 16, a displacer rod 18, a displacer spring 20, a casing 22, a regenerator 24, an acceptor or cold portion 26 and a rejector or hot portion 28. The function of these elements is well known in the art, and, therefore, will not be explained further here.

With reference to FIGS. 2–5, there is shown a beverage container vending machine 30. The vending machine includes a plurality of vertical, spaced partitions 32 that define a vertical container stacking and dispensing path 34. Disposed in each dispensing path 34 between each spaced pair of partitions 32 is a plurality of containers 36, such as beverage containers. Dispensing apparatus 38 located at the bottom of each dispensing path 34 dispenses individual containers 36 stacked in the dispensing path into a chute 40 which delivers the dispensed container to a dispensing door 42 in a manner well known in the art. The vending machine 30 includes insulated walls 44 that form an insulated enclosure to reduce the amount of heat transfer from outside the insulated enclosure to inside the enclosure, thereby helping to maintain the containers and the contents thereof at a desired temperature. The chute 40 can be made from a wire mesh so that circulation of air within the insulated enclosure is not significantly impaired by the chute.

Figure 3:
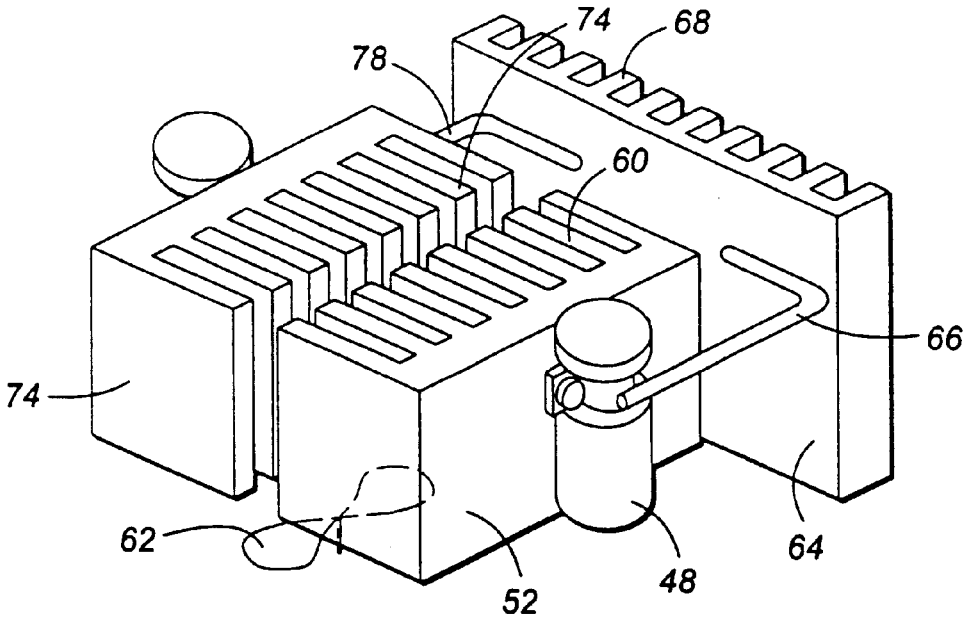
FIG. 3 is a partial perspective view of the lower portion of the vending machine shown in FIG. 2.
Figure 4:
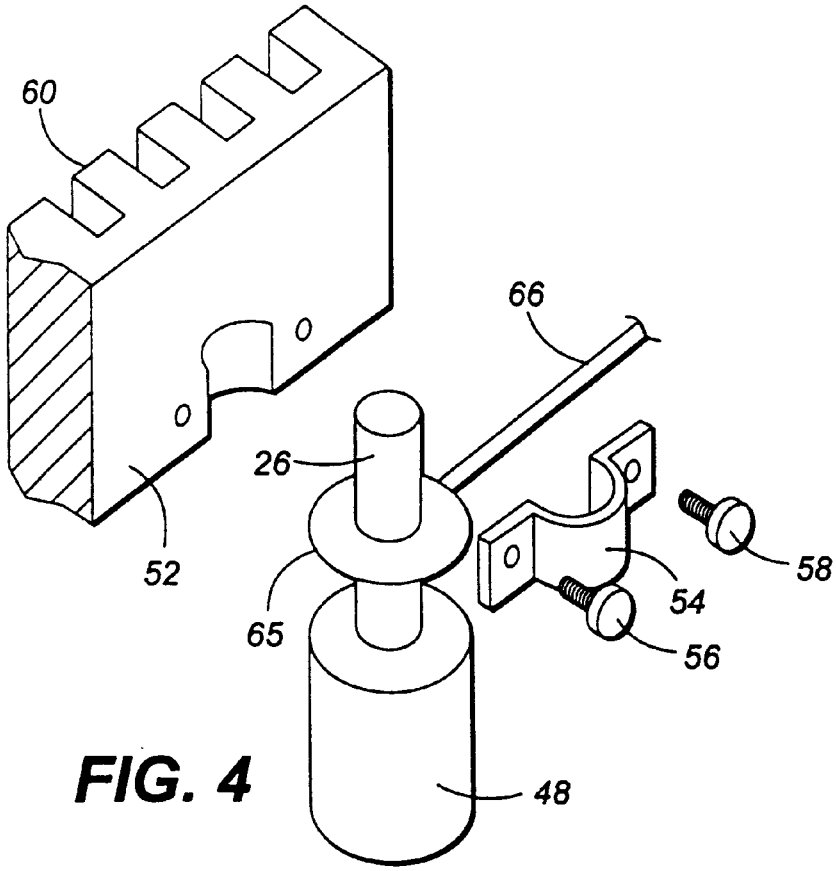
FIG. 4 is a partial exploded perspective view of the portion of the vending machine shown in FIG. 3.

Disposed in the lower portion 46 of the vending machine 30 is a pair of Stirling coolers 48, 50. Although the present invention is illustrated as using two Stirling coolers, it is specifically contemplated that a single Stirling cooler or more than two Stirling coolers can be used. With reference to FIG. 3, the cold portion 26 of the first Stirling cooler 48 is attached to a rectangular member 52 made from a heat-conducting material, such as aluminum. The cold portion 26 of the first Stirling cooler 48 is attached to the rectangular member 52 by a clamping member 54 that attaches to the member 52 with threaded bolts 56, 58. A plurality of fins 60 are formed in the member 52 so as to increase the surface area of the member exposed to the ambient air inside the insulated enclosure. When the Stirling cooler is operating, heat will flow from the ambient air surrounding the member 52, through the member 52 to the cold portion 26 of the Stirling cooler 48. Through the operation of the Stirling cooler 48, heat absorbed at the cold portion of the Stirling cooler is transferred to the hot portion 28 (FIG. 1) of the Stirling cooler. A fan 62 can be provided adjacent the member 52 to assist in the circulation of air inside the insulated enclosure.

In order for the Stirling cooler 48 to work properly, the heat transferred to the hot portion 28 must be dissipated from the Stirling cooler. To perform this function, a radiator assembly is provided in heat exchange relationship with the hot portion 28. The radiator assembly comprises an elongate, rectangular member 64 connected in heat exchange relationship with the hot portion 28 of the Stirling cooler 48. The radiator member 64 is connected to the hot portion 28 of the first Stirling cooler 48 by a heat pipe 66. Heat pipes are well known to those skilled in the art.

Briefly, heat pipes are simple devices that can quickly transfer heat from one point to another without the need of energy input. Heat pipes possess an extraordinary heat transfer capacity with almost no loss. The heat pipe itself is not a new invention; early heat pipes developed near the turn of the century, were constructed out of hollow metal tubes which were sealed at both ends, evacuated and then charged with a small amount of a volatile fluid. Heat pipes also contained a "wick" to transport the fluid from one end of the heat pipe to the other.

Relying on the energy absorbed and released from the "phase-change" of the fluid, a hollow heat pipe transfers heat at extremely high speed. Heat applied to one end of the pipe almost instantaneously evaporates the fluid inside. This vapor then moves to the opposite "colder" end of the pipe and condenses back to a liquid form, thereby releasing the heat absorbed during evaporation.

Heat pipes useful in the present invention are shown in U.S. Pat. Nos. 4,941,527; 5,076,351 and 5,309,351, the disclosures of which are incorporated herein by reference. Furthermore, the heat pipes can have any suitable cross-sectional shape, such as round, rectangular, or the like.

The hot portion 28 of the Stirling cooler 48 is wrapped in insulation 65 so that heat from the hot portion will not be transferred to the ambient air inside the insulated enclosure. Similarly, the portion of the heat pipe 66 inside the insulated enclosure is wrapped in insulation (not shown) so that heat from the heat pipe will not be transferred to the ambient air inside the insulated enclosure.

A plurality of fins 68 are formed in the radiator member 64 so as to increase the surface area of the radiator member exposed to the ambient air outside the insulated enclosure. When the Stirling cooler 48 is operating, heat will flow from the hot portion 28 of the Stirling cooler through the heat pipe 66 and through the radiator member 64 to the ambient air surrounding the member 64. Louvers 70, 72 are provided in the side and the back, respectively, of the vending machine so that air outside the vending machine will circulate around the radiator member 64 through convection. Alternately, a fan (not shown) may be positioned adjacent the radiator member 64 to assist in moving air across the radiator member. The end result is that the Stirling cooler 48 pumps or transfers heat from the ambient air inside the insulated enclosure to the ambient air outside the insulated enclosure and the heated air outside the insulated enclosure is dissipated out the louvers 70, 72.

An identical arrangement of the second Stirling cooler 50 is provided to mirror the first Stirling cooler 48. The mirrored system includes a rectangular member 74 made from a heat-conducting material, such as aluminum, attached to the cold portion 26 of the second Stirling cooler 50. The member 74 is secured to the cold portion 26 of the second Stirling cooler 50 by a clamping member (not shown) that attaches to the member 74 with threaded bolts (not shown) in the same manner as previously described with respect to the first Stirling cooler 48. A plurality of fins 76 are formed in the member 74 so as to increase the surface area of the member exposed to the ambient air inside the insulated enclosure. When the second Stirling cooler 50 is operating, heat will flow from the ambient air surrounding the member 74, through the member 74 to the cold portion 26 of the Stirling cooler 50. Through the operation of the second Stirling cooler 50, heat absorbed at the cold portion 26 of the second Stirling cooler is transferred to the hot portion 28 (FIG. 1) of the second Stirling cooler.

In order for the second Stirling cooler 50 to work properly, the heat transferred to the hot portion 28 must be dissipated from the Stirling cooler. To perform this function, a radiator assembly is provided in heat exchange relationship with the hot portion. The radiator assembly comprises the radiator member 64 connected in heat exchange relationship with the hot portion 28 of the second Stirling cooler 50. The radiator member 64 is connected to the hot portion 28 of the second Stirling cooler 50 by a heat pipe 78.

The hot portion 28 of the Stirling cooler 50 is wrapped in insulation 80 so that heat from the hot portion will not be transferred to the ambient air inside the insulated enclosure. Similarly, the portion of the heat pipe 78 inside the insulated enclosure is wrapped in insulation (not shown) so that heat from the heat pipe will not be transferred to the ambient air inside the insulated enclosure.

When the Stirling cooler 50 is operating, heat will flow from the hot portion 28 of the Stirling cooler, through the heat pipe 78 and through the radiator member 64 to the ambient air surrounding the radiator member. Louvers 70, 72 provided in the side and the back, respectively, of the vending machine permit air outside the vending machine to circulate around the member 64 through convection. The end result is that the second Stirling cooler 50 pumps or transfers heat from the ambient air inside the insulated enclosure to the ambient air outside the insulated enclosure and the heated air is dissipated out the louvers 70, 72.

Although the Stirling coolers 48, 50 are shown as both being connected to separate members 52, 74, it is specifically contemplated that both Stirling coolers could be connected to a single heat-absorbing member inside the insulated enclosure. Furthermore, although the Stirling coolers 48, 50 are shown as being directly connected to the heat-absorbing members 52, 74, it is specifically contemplated that the Stirling coolers can be disposed so that the Stirling coolers are located outside the insulated wall 44 and the cold portion 26 of the Stirling coolers 48, 50 are connected by heat pipes, or other heat conducting members, to the heat-absorbing members 52, 72 in a heat transfer relationship in a manner similar to that shown for the radiator member 64.

The Stirling coolers 48, 50 and fan 62 are connected by wires (not shown) to an electrical circuit (not shown) that provides electricity to the Stirling coolers and fan to operate them. Control circuitry (not shown) and temperature sensors (not shown) inside the insulated enclosure provide proper operation of the Stirling coolers so that a desired temperature is maintained inside the insulated enclosure.

The Stirling coolers 48, 50 are relatively easy to service. If a Stirling cooler 48, 50 fails, it can be replaced with a new Stirling cooler merely by unbolting the failed Stirling cooler from one of the clamps 54 securing the failed Stirling cooler to one of the members 52, 74, disconnecting the failed Stirling cooler from its associated heat pipe 66, 78 and disconnecting the failed Stirling cooler from the electrical circuitry (not shown). A new Stirling cooler can then be attached to the electrical circuitry (not shown), to one of the heat pipes 66, 78 and to one of the members 52, 74 by bolting the corresponding clamping member 54 thereto. The dual Stirling coolers also permit the continued cooling of the insulated enclosure if one Stirling cooler fails. Furthermore, during servicing of a failed Stirling cooler, the other Stirling cooler can continue to operate. Moreover, during peak cooling loads, both Stirling coolers 48, 50 can be operated at maximum capacity. However, during minimal cooling requirements, it may be necessary to only operate one of the Stirling coolers 48, 50, thus, providing operating efficiencies in terms of energy consumption.

Figure 6:
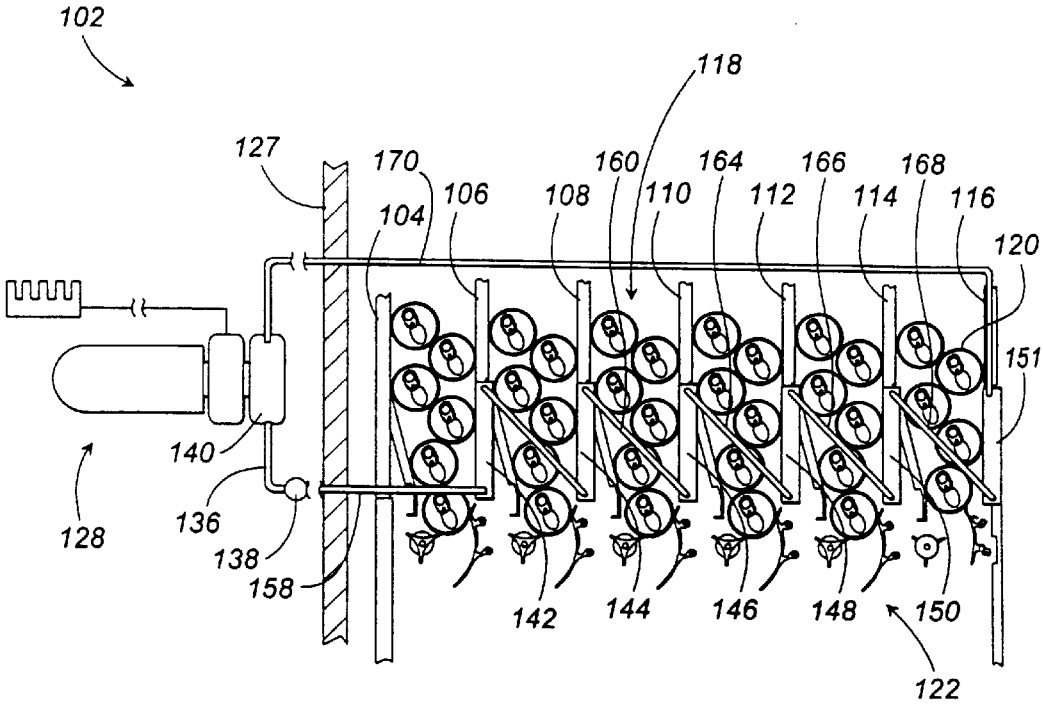
FIG. 6 is a partial schematic view of the vending machine shown in FIG. 5, showing the container stacking and dispensing apparatus.

With reference to FIG. 6, there is shown a beverage container vending machine 102. The vending machine includes a plurality of vertical, spaced partitions 104–116 (FIG. 6) that define a vertical container stacking and dispensing paths 118 therebetween. Disposed in each dispensing path 118 between each spaced pair of partitions 104–116, such as the partitions 114, 116, is a plurality of containers 120, such as beverage containers. Dispensing apparatus 122 located at the bottom of each dispensing path 118 dispenses individual containers 120 stacked in the dispensing path into a chute 124, which delivers the dispensed container to a dispensing door 126 in a manner well known in the art. The vending machine 102 includes insulated walls 127 that form an insulated enclosure to reduce the amount of heat transfer from outside the insulated enclosure to inside the enclosure, thereby helping to maintain the containers and the contents thereof at a desired temperature.

Disposed outside the insulated enclosure of the vending machine 102 is a free-piston Stirling cooler 128 of the type shown in FIG. 1. Although the Stirling cooler 128 can be located below the bottom insulated wall 127, it is specifically contemplated that the Stirling cooler can be disposed at any location outside the insulated enclosure, such as above or behind the insulated enclosure.

Attached to the cold portion 26 of the Stirling cooler 128 in heat exchange relationship therewith is a fluid heat exchanger 130 comprising an annular collar 131 that defines a toroidal-shaped fluid passage 132 (FIG. 1). The fluid heat exchanger 130 also includes a fluid inlet 134 and a fluid outlet 136 that are in fluid communication with the fluid passage 132 (FIG. 1). A fluid pump 138 is connected to the fluid outlet 136 of the fluid heat exchanger 130 so that when connected to a tube or pipe that is, in turn, connected to the fluid inlet 134, a heat transfer fluid can be circulated through the fluid heat exchanger 131 in the direction shown by the arrows (FIG. 1) such that heat contained by the heat transfer fluid can be transferred to the cold portion 26 of the Stirling cooler.

The composition of the heat transfer fluid used in the present invention is not critical to the invention. Many suitable heat transfer fluids are known to those skilled in the art, such as water or water plus 50% by weight ethylene glycol.

The cold portion 26 of the Stirling cooler 128 and the fluid heat exchanger 130 are enclosed in insulation 140 (FIG. 6) to minimize the amount of ambient heat that is transferred to the cold portion of the Stirling cooler. The Stirling cooler 128 is also provided with a heat radiator system as described previously with respect to the Stirling coolers 48, 50. The heat radiator system comprises a heat pipe 82 connecting a radiator member 84 and the hot portion 28 of the Stirling cooler 128 in heat exchange relationship.

Each of the dispensing paths 118 is at least partially defined by a heat transfer plate 142–151. The heat transfer plates 142–151 are located at the bottom of the dispensing paths 118 adjacent the dispensing apparatus 122. As can be seen from FIG. 6, at least a portion of each container 120 disposed in a dispensing path 118 contacts a heat transfer plate 142–151 before it is dispensed from a dispensing path. As will be appreciated by those skilled in the art, heat transfer by contact, i.e., a solid contacting another solid, is much more efficient than heat transfer by convection, i.e., from a solid material to a gas. Furthermore, those containers 120 disposed in the lower portion of a dispensing path are located in close proximity to a heat transfer plate 142–151 when not in actual contact therewith.

Figure 7:
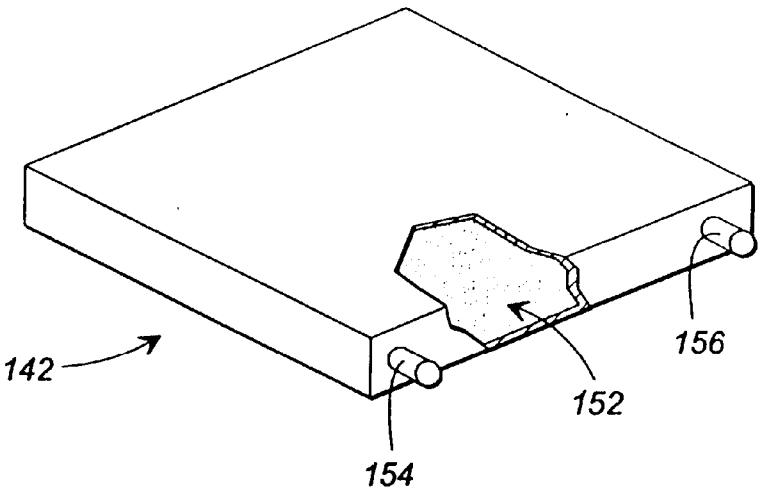
FIG. 7 is a perspective view of a heat transfer plate used in the vending machine shown in FIG. 5, shown in partial cutaway.

The heat transfer plates 142–151 are made from a heat-conducting material, such as aluminum. As can be seen in FIG. 7, the heat-conducting plates 142–151 each are hollow so as to define a fluid chamber 152 therein to contain a heat transfer fluid. Furthermore, each plate 142–151 includes a fluid inlet 154 and a fluid outlet 156 for fluid communication with the fluid chamber 152.

With reference again to FIG. 6, it can be seen that the pump 138 is connected to the fluid inlet 154 of the plate 142 by a tube or pipe 158. The fluid outlet 156 of the plate 142 is connected to the fluid inlet 154 of the plate 144 by a tube or pipe 160. The fluid outlet 156 of the plate 144 is connected to the fluid inlet 154 of the plate 146 by a tube or pipe 162. The fluid outlet 156 of the plate 146 is connected to the fluid inlet 154 of the plate 148 by a tube or pipe 164. The fluid outlet 156 of the plate 148 is connected to the fluid inlet 154 of the plate 150 by a tube or pipe 166. The fluid outlet 156 of the plate 150 is connected to the fluid inlet 154 of the plate 151 by a tube or pipe 168. The fluid outlet 156 of the plate 151 is connected to the fluid inlet 134 of the fluid heat exchanger 130 on the Stirling cooler 128 by a tube or pipe 170.

When the fluid heat exchanger 130 is connected in series to the plates 142–151, the heat transfer fluid contained therein can be circulated by the pump 138 from the fluid heat exchanger 130 to the plates 142–151, sequentially, and then back to the fluid heat exchanger. Thus, heat from the air surrounding the plates 142–151 will be transferred to the plates, from the plates to the fluid within the plates and then to the cold portion 26 of the Stirling cooler 128. Furthermore, when a container 120 contacts one of the plates 142–151, heat from the container, and from the contents of the container, will be transferred to the plates, from the plates to the fluid within the plates and then to the cold portion 26 of the Stirling cooler 128. As previously mentioned, contact between the containers 120 and the plates 142–151 is desirable because it provides a more efficient heat transfer than trying to cool the containers using gas convection. Thus, the removal of heat from the region adjacent the dispensing end of the dispensing paths and from the containers adjacent the dispensing end of each dispensing path is a relatively efficient method of cooling the contents of the containers.

Figure 8:
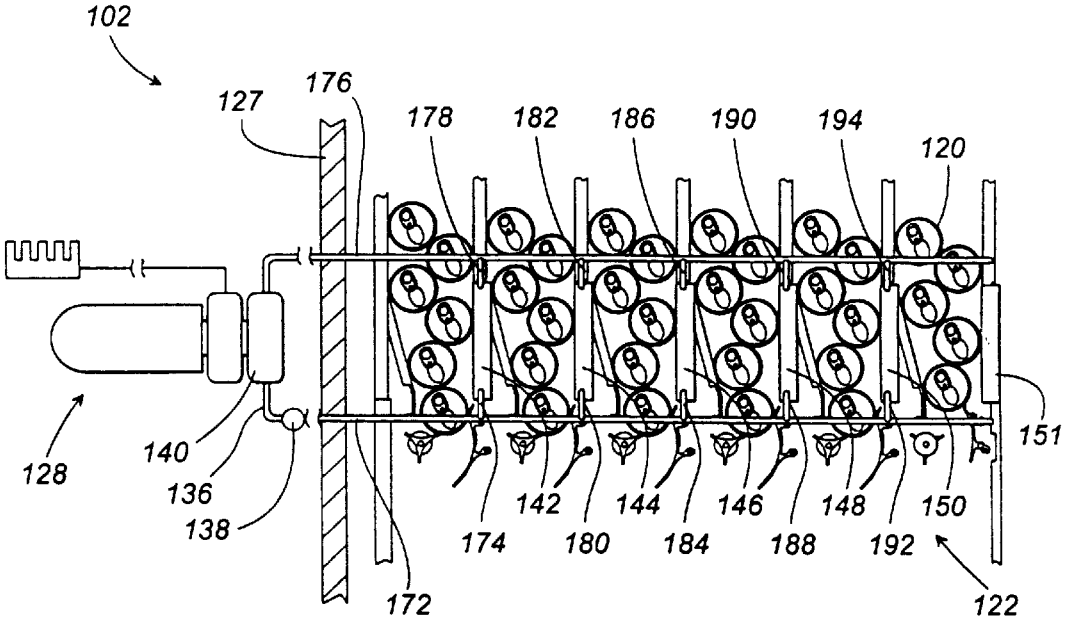
FIG. 8 is a partial schematic view of an alternate disclosed embodiment of the vending machine shown in FIG. 5, showing the container stacking and dispensing apparatus.

With reference to FIG. 8, it will be seen that there is an alternate disclosed embodiment to the series heat transfer system shown in FIG. 6. In FIG. 8, the heat transfer fluid is distributed to the heat transfer plates 142–151 in parallel, rather than in series. Thus, the pump 138 is connected to one end of a lower manifold pipe or tube 172. The lower manifold pipe or tube 172 is connected to the fluid inlet 152 of the plate 142 by a pipe or tube 174 and the fluid outlet 156 of the plate 142 is connected to an upper manifold pipe or tube 176 by a pipe or tube 178. The upper manifold pipe or tube 176 is connected at one end thereof to the fluid inlet 134 of the fluid heat exchanger 130 on the Stirling cooler 128. The lower manifold pipe or tube 172 is connected to the fluid inlet 152 of the plate 144 by a pipe or tube 180 and the fluid outlet 156 of the plate 144 is connected to the upper manifold pipe or tube 176 by a pipe or tube 182. The lower manifold pipe or tube 172 is connected to the fluid inlet 152 of the plate 146 by a pipe or tube 184 and the fluid outlet 156 of the plate 146 is connected to the upper manifold pipe or tube 176 by a pipe or tube 186. The lower manifold pipe or tube 172 is connected to the fluid inlet 152 of the plate 148 by a pipe or tube 188 and the fluid outlet 156 of the plate 148 is connected to the upper manifold pipe or tube 176 by a pipe or tube 190. The lower manifold pipe or tube 172 is connected to the fluid inlet 152 of the plate 150 by a pipe or tube 192 and the fluid outlet 156 of the plate 150 is connected to the upper manifold pipe or tube 176 by a pipe or tube 194. The other end of the lower manifold pipe or tube 172 is connected to the fluid inlet 152 of the plate 151 and the fluid outlet 156 of the plate 151 is connected to the other end of the upper manifold pipe or tube 176.

When the fluid heat exchanger 130 is connected in parallel to the plates 142–151, the heat transfer fluid contained therein can be circulated by the pump 138 from the fluid heat exchanger 130 to the plates 142–151 equally and at the same time and then back to the fluid heat exchanger. Thus, heat from the air surrounding the plates 142–151 will be transferred to the plates, from the plates to the fluid within the plates and then to the cold portion 26 of the Stirling cooler 128. Furthermore, when a container 120 contacts one of the plates 142–151, heat from the container, and from the contents of the container, will be transferred to the plates, from the plates to the fluid within the plates and then to the cold portion 26 of the Stirling cooler 128.

Although the present invention has been illustrated as using hollow heat transfer plates 142–151, it is specifically contemplated that the heat transfer plates may be made from a solid heat-conducting material, such as solid aluminum, and that the pipes or tubes connecting the heat transfer plates to the fluid heat exchanger 130, at least a portion of which would be made from a heat-conducting material, could merely contact the heat transfer plates so as to exchange heat between the solid heat transfer plate and the heat transfer fluid circulating within the pipes or tubes. There are many ways known to those skilled in the art to achieve this heat transfer. Thus, the only critical feature is that the heat transfer fluid circulated to and from the fluid heat exchanger 130 must be placed in heat exchange relationship with the heat transfer plates 142–151.

Although the present invention has been illustrated as having straight, vertically oriented partitions 104–116, and straight, vertically oriented dispensing paths 118, it is specifically contemplated that other shaped partitions and other shaped dispensing paths can be utilized with the present invention. For example, it is known to use spaced partitions that are arranged in a serpentine manner. It is also known to use spaced partitions that are arranged like slanted shelves. The orientation of the spaced shelves or the geometry of the stacked containers is not critical to the present invention. The only critical feature of the present invention is that the heat-conducting portion of a pair of spaced partitions must be located adjacent the dispensing end of the dispensing path.

Figure 9:
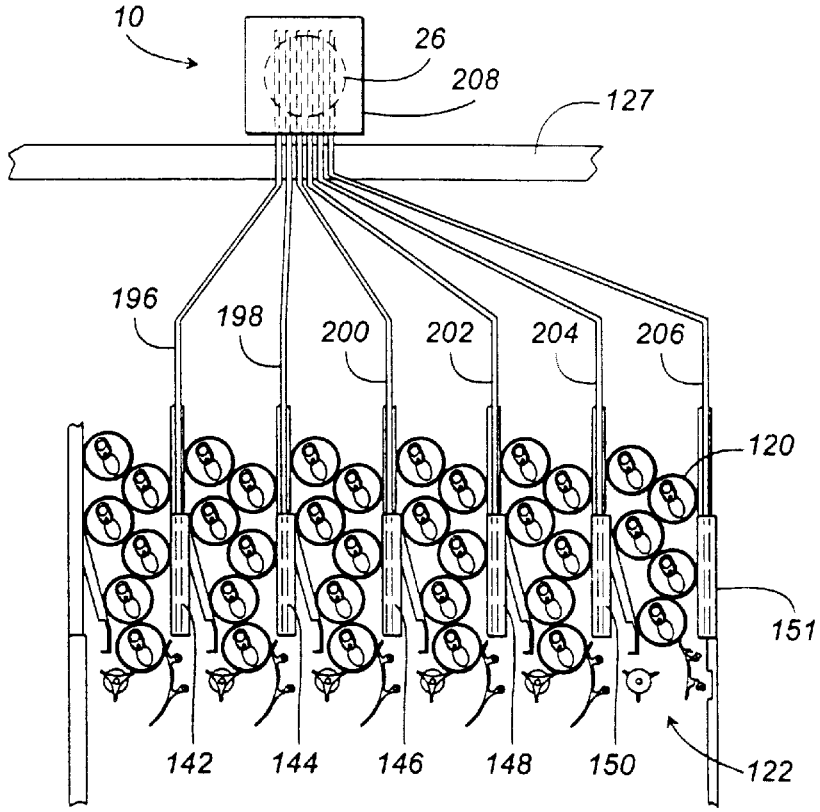
FIG. 9 is a schematic view of another alternate disclosed embodiment of the vending machine shown in FIG. 5, showing the container stacking and dispensing apparatus.

With reference to FIG. 9, it will be seen that there is an alternate disclosed embodiment to the fluid heat transfer system shown in FIGS. 5–8. Instead of pumping a heat transfer fluid from a heat exchanger connected to the cold portion of a Stirling cooler to the heat transfer plates, this alternate embodiment utilizes heat pipes.

Again, referring to FIG. 9, each heat transfer plate 142–151 is connected to the cold portion 26 of a Stirling cooler by a heat pipe 196–206. Specifically, the evaporative end of each heat pipe 196–206 is embedded into the solid heat-conducting material of the heat transfer plates 142–151. This can be done in any manner that places the heat pipe in heat exchange relationship with the heat transfer plate 142–151, such as by drilling a hole in the solid plate and inserting the end of a heat pipe therein. Similarly, the condensing end of each heat pipe 196–202 is embedded into a solid block 208 of heat-conducting material in contact with the cold portion 26 of a Stirling cooler 10. The block 208 of material, which can be made from aluminum, is attached to the end of the heat pipes 196–202 in any manner that places the heat pipe in heat exchange relationship with the solid block, such as by drilling a hole in the solid block and inserting the end of a heat pipe therein, by mechanical contact, by welding and the like.

When the Stirling cooler 10 (FIG. 9) is operating, heat from the air surrounding the heat transfer plates 142–151 and heat from the containers 120 contacting the heat transfer plates causes liquid in the end of the heat pipes 196–206 embedded in the heat transfer plates to volatilize, thereby absorbing the heat of vaporization. The volatilized liquid travels to the opposite end of the heat tube and condenses. In condensing, the heat of condensation is released and transferred through the heat-conducting material of the block 208 to the cold portion 20 of the Stirling cooler 10. The condensed liquid in the heat pipe is transported from the condensation end to the evaporation end by a wick (not shown) inside the pipe, typically made from a sintered metal. The liquid delivered to the evaporation end by the wick is therefore available to re-vaporize and repeat the heat transfer cycle. Thus, when using heat pipes, heat at the heat transfer plates 142–151 is rapidly and efficiently transferred to the cold portion 26 of the Stirling cooler 10 without the need for a pump as shown in FIGS. 6 and 8.

Figure 11:
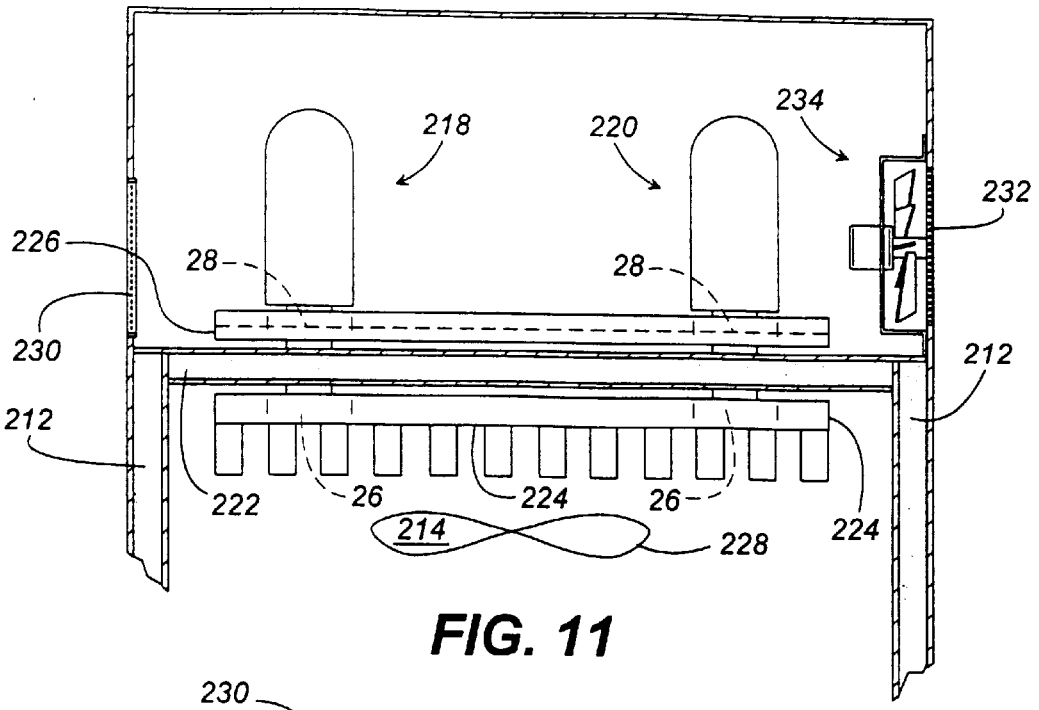
FIG. 11 is a partial cross-sectional view of the glass door merchandiser shown in FIG. 10.
Figure 10:
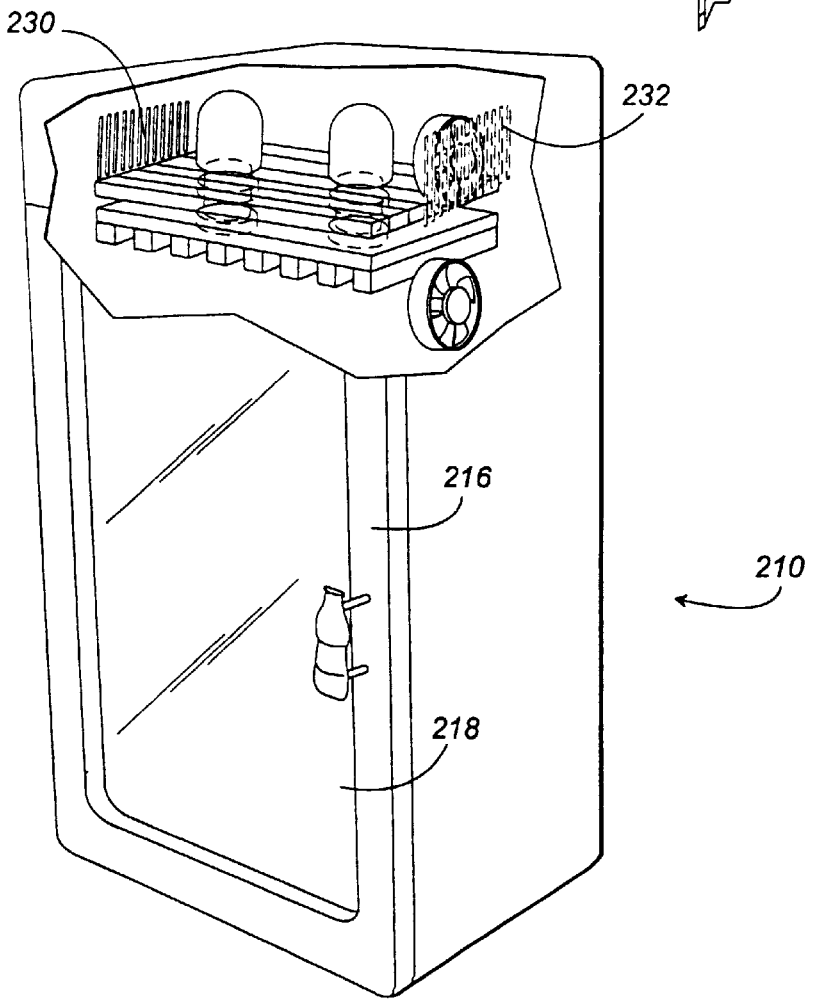
FIG. 10 is a perspective view of a disclosed embodiment of a glass door merchandiser in accordance with the present invention shown in partial cutaway.

With reference to FIGS. 10 and 11 there is shown a GDM 210. The GDM 210 comprises a rectangular box having insulated walls 212 that define an insulated enclosure 214. The GDM 210 is provided with an openable, hinged door 216 having a glass window 218 therein so that the contents of the insulated enclosure can be viewed from the outside without opening the door. GDMs typically have a plurality of horizontal shelves (not shown) disposed therein upon which can be placed a plurality of containers (not shown), such as beverage containers.

Disposed in the upper portion of the GDM 210 outside the insulated enclosure 214 is a pair of Stirling coolers 218, 220. Although the present invention is shown using two Stirling coolers, it is specifically contemplated that a single Stirling cooler or more than two Stirling coolers can be utilized. Holes (not shown) are provided in the top insulated wall 222 of the insulated enclosure 214 so that a portion of each Stirling cooler can extend through the insulated wall. The Stirling coolers 218, 220 are arranged so that the cold portion 26 of each Stirling cooler is disposed inside the insulated enclosure and the hot portion 28 of each Stirling cooler is disposed outside the insulated enclosure. The cold portion 26 of each Stirling cooler 218, 220 is attached in a heat-conducting relationship to a rectangular plate 224 disposed inside the insulated enclosure. The plate 224 is made from a heat-conducting material, such as aluminum. The hot portion 28 of each Stirling cooler 218, 220 is attached in a heat-conducting relationship to a rectangular plate 226 disposed outside the insulated enclosure. The plate 226 is made from a heat-conducting material, such as aluminum. Both the plate 224 and the plate 226 can be provided with fins of the type shown in FIGS. 3 and 4 so as to increase the surface area of the plates.

An electric fan 228 is provided inside the insulated enclosure for circulating air within the insulated enclosure. Louvers 230, 232 are provided on opposite sides of the upper portion of the GDM 210. An electric fan 234 is also provided outside the insulated enclosure adjacent the louvers 232. The fan 234 forces air out the louvers 232 resulting in outside air being drawn in the louvers 230.

When the two Stirling coolers 218, 220 are operating, heat from the air surrounding the plate 224 will be transferred to the plate, and then from the plate to the cold portions 26 of both Stirling coolers. Circulation of the air inside the insulated enclosure by the fan 228 facilitates this heat transfer. Through the operation of the Stirling coolers 218, 220, the heat transferred to the cold portion 26 of each Stirling coolers is transferred to the hot portion 28 of each Stirling cooler. The heat from the hot portion 28 of each Stirling coolers 218, 220 is then transferred to the plate 226, and then from the plate to the surrounding air. The movement of air across the plate 26 by the fan 234 facilitates this heat transfer.

Figure 12:
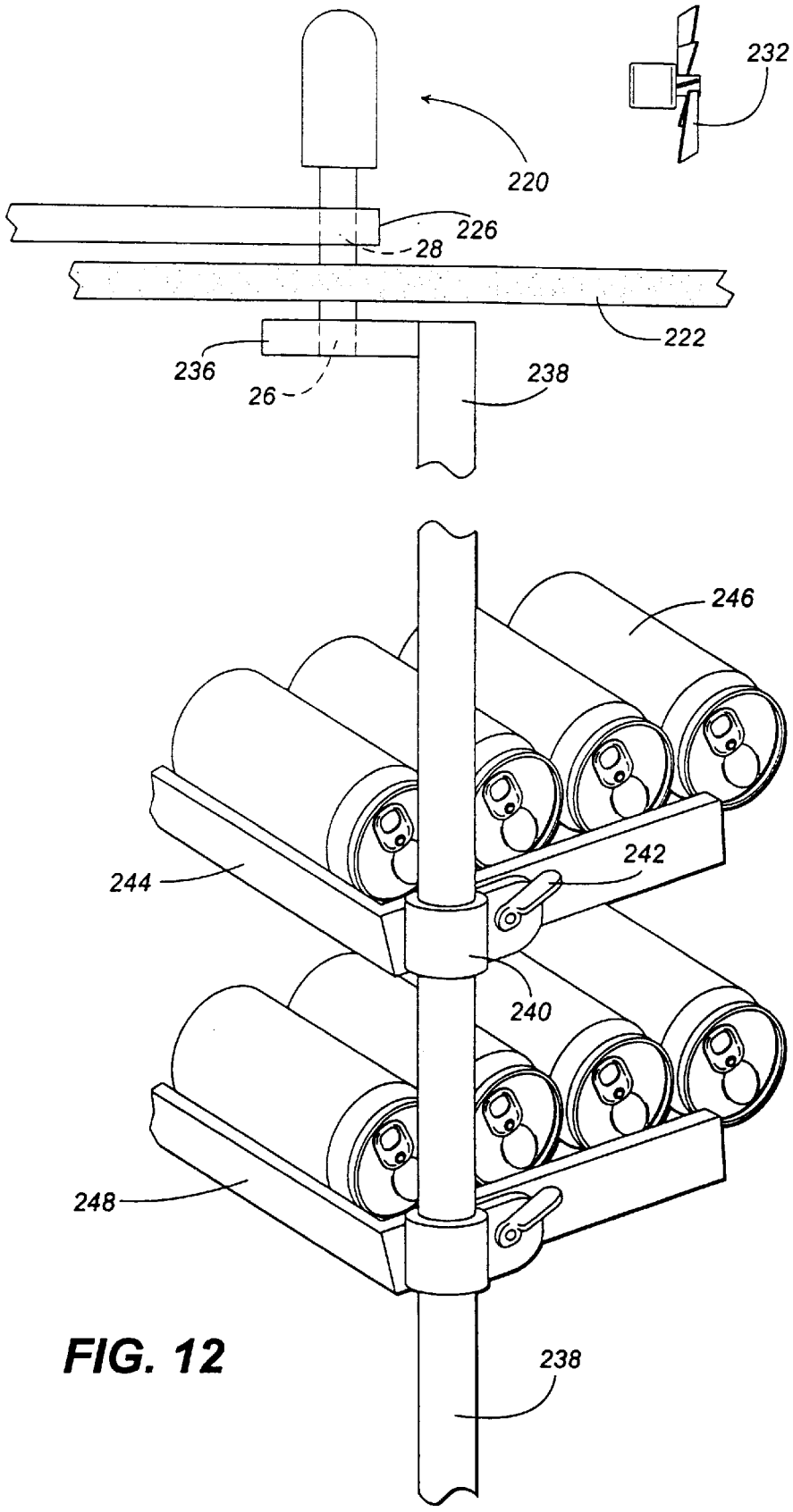
FIG. 12 is partial cross-sectional view of an alternate disclosed embodiment of the glass door merchandiser shown in FIG. 10.

With reference to FIG. 12, there is shown an alternate embodiment of the GDM shown in FIGS. 10 and 12. With respect to the embodiment shown in FIG. 12, the portion of the GDM 210 above the insulated top wall 222 is the same as shown in FIGS. 10 and 11; however, the portion below the insulated top wall is different.

The cold portions 26 of both Stirling coolers 218, 220 extend below the insulated top wall 222 inside the insulated enclosure. Attached to the cold portion 26 of each Stirling cooler 218, 220 in heat exchange relationship therewith is an elongate bracket 236. The bracket 236 is made from a heat-conducting material, such as aluminum. The elongate bracket is disposed such that one end thereof is adjacent the front of the enclosure and the other end is adjacent the rear of the enclosure. Attached to each end of the bracket 236 is a vertically oriented heat pipe 238 that extends from the bracket 236 to a bottom bracket (not shown) at the bottom of the insulated enclosure. The bottom bracket (not shown) and the bracket 238 securely hold the heat pipes in a vertical position. Thus, there is a vertically oriented heat pipe 238 disposed adjacent each of the four corners of the insulated enclosure. Although the present invention has been shown as using four heat pipes, it is specifically contemplated that the present invention can use one or more heat pipes.

Slidably mounted on each heat pipe is a clamp 240. The clamp 240 includes a lever 242 that selectively permits the clamp to slide up and down on the heat pipe 238 or to lock the clamp at a desired location on the heat pipe. The clamp 240 is made from a heat-conducting material, such as aluminum. Attached to each comer of a rectangular shelf 244 is one of the slidable clamps 240. Thus, the shelves are slidable or adjustable up and down in order to accommodate containers of different sizes. Disposed on the shelf 244 are a plurality of containers 246, such as beverage containers. The containers 246 are in heat exchange relationship with the shelf 244. Multiple identical shelves 248 can also be provided within the insulated enclosure. The shelves 244, 248 are made from a heat-conducting material, such as aluminum. Although the present invention has been shown as using shelves 244, 248 made from solid metal, it is specifically contemplated that the shelves can be made from a material that will not substantially restrict air flow within the insulated enclosure, such as wire shelves.

When the Stirling coolers 218, 220 are operating, heat from the air surrounding the shelves 244, 248 and heat from the containers disposed on the shelves is transferred to the shelves, from the shelves to the bracket 240 and from the bracket to the heat pipe 238. The heat transferred to the heat pipe 238 causes liquid in the heat pipe to volatilize, thereby absorbing the heat of vaporization. The volatilized liquid, i.e., gas, travels to the opposite end of the heat tube and condenses. In condensing, the heat of condensation is released and transferred through the bracket 236 to the cold portion 26 of the Stirling cooler 220. The condensed liquid in the heat pipe 238 is transported from the condensation end to the evaporation end by a wick (not shown) inside the pipe or by gravity. The liquid delivered to the evaporation end by the wick is therefore available to re-vaporize and repeat the heat transfer cycle. Thus, when using heat pipes, heat from the shelves 244, 248 and the air surrounding the shelves is rapidly and efficiently transferred to the cold portion 26 of the Stirling cooler 220 without the need for a pump. Furthermore, since the containers 246 are in contact with the heat-conducting shelves 244, 248 the heat transfer therebetween is relatively efficient.

Through the operation of the Stirling coolers 218, 220, the heat transferred to the cold portions 26 of both Stirling coolers is transferred to the hot portions 28 of both Stirling coolers. The heat from the hot portions 28 of both Stirling coolers 218, 220 is then transferred to the plate 226, and then from the plate to the surrounding air. The movement of air across the plate 226 by the fan 232 facilitates this heat transfer.

Figure 14:
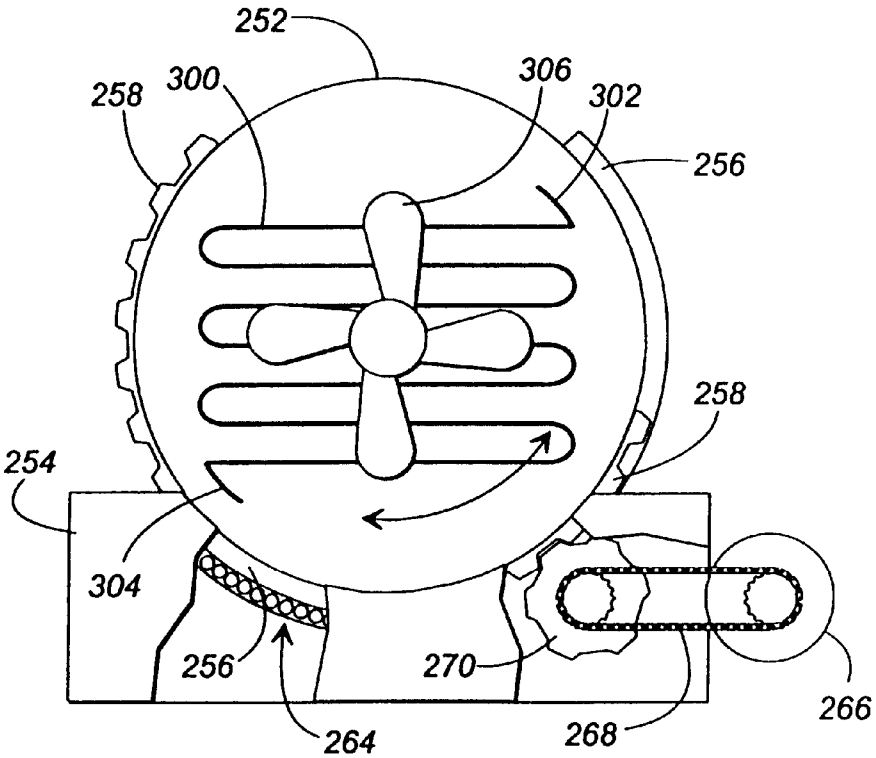
FIG. 14 is a detailed end view of the container chilling apparatus shown in FIG. 13.
Figure 13:
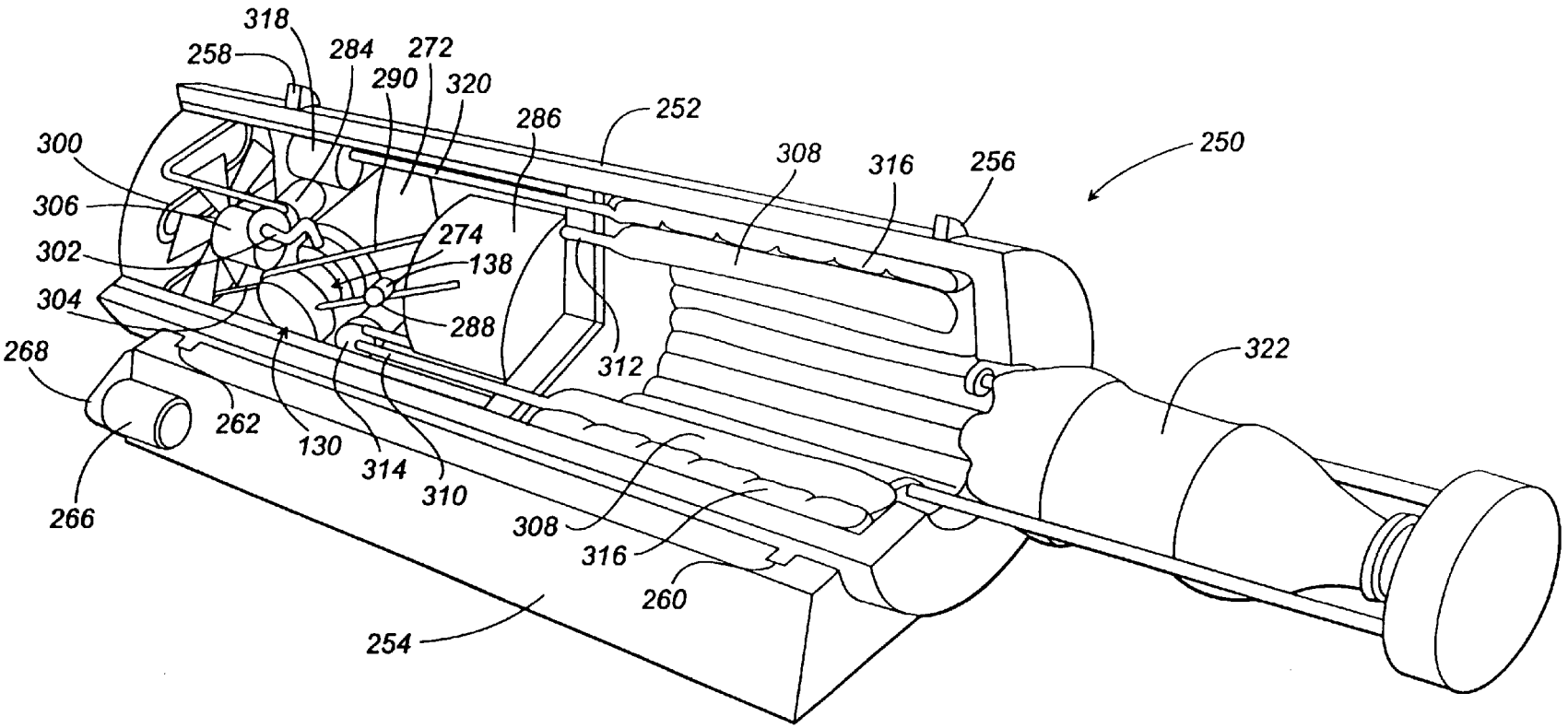
FIG. 13 is a perspective view of a disclosed embodiment of a container chilling apparatus in accordance with the present invention shown in partial cutaway.
Figure 15:
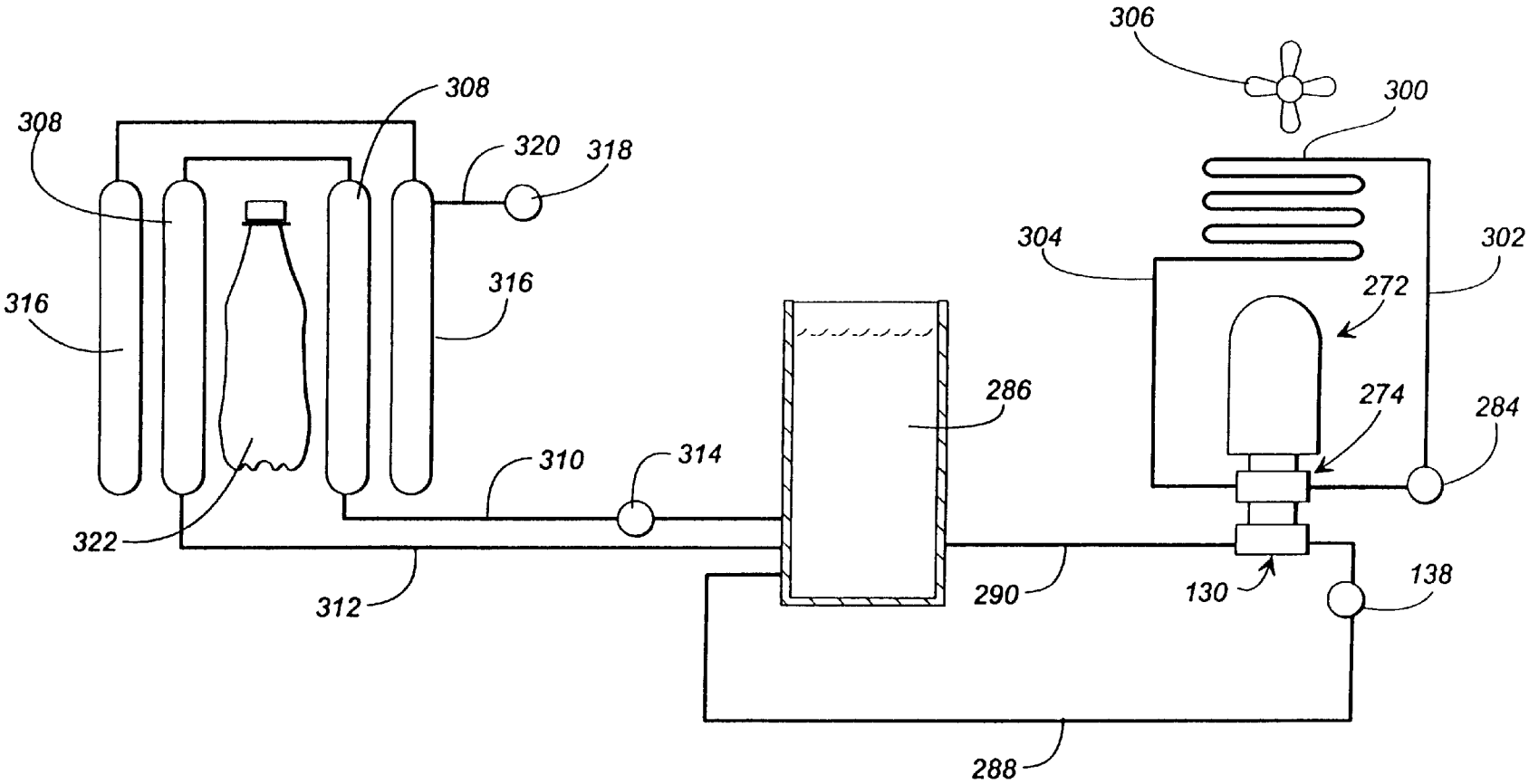
FIG. 15 is a schematic view of the container chilling apparatus shown in FIG. 13.

With reference to FIGS. 13–15, there is shown a container rapid chilling apparatus 250. The apparatus 250 comprises an elongate cylindrical body 252 rotatably mounted about its longitudinal axis on a bed 254. Two tracks 256, 258 ride in mating channels 260, 262 formed in the bed 254. Ball bearings 264 are provided in channel 260 upon which the flat track 256 freely rides. Mounted on the bed 254 is an electric motor 266. The rotatable shaft (not shown) of the motor 266 is connected to a chain 268 that in turn is connected to a rotatably mounted gear 270. The track 258 is provided with gear teeth that mesh with the teeth of the gear 270. The motor 266 is connected to a controller (not shown) that controls the operation of the motor. The controller (not shown ) is designed to operate the motor 226 so as to repeatedly rotate the cylindrical body 252 in one direction through 270° of rotation and back again at the rate of approximately one cycle; i.e., rotation forward and backward, every 2 to 10 seconds; preferably approximately every 5 seconds.

Disposed within the cylindrical body 252 is a Stirling cooler 272. The cold portion 26 of the Stirling cooler 272 is provided with a fluid heat exchanger 130 (FIG. 1). Attached to the hot portion 28 of the Stirling cooler 272 in heat exchange relationship therewith is a fluid heat exchanger 274 comprising an annular collar 276 that defines a toroidal-shaped fluid passage 278 (FIG. 1). The annular collar 276 is made from a heat-conducting material, such as aluminum. The fluid heat exchanger 130 also includes a fluid inlet 280 and a fluid outlet 282 that are in fluid communication with the fluid passage 278 (FIG. 1). A fluid pump 284 is connected to the fluid outlet 282 of the fluid heat exchanger 274 so that when connected to a tube or pipe that is, in turn, connected to the fluid inlet 280, a heat transfer fluid can be circulated through the fluid heat exchanger in the direction shown by the arrows (FIG. 1) such that heat from the hot portion 28 of the Stirling cooler is transferred to the heat transfer fluid flowing through the fluid heat exchanger.

Again with reference to FIGS. 13–15, the outlet 136 of the fluid heat exchanger 130 attached to the cold portion 26 of the Stirling cooler 274 is connected to a fluid reservoir 286 by a pipe or tube 288; the fluid reservoir is connected to the inlet 134 of the fluid heat exchanger by a pipe or tube 290. The fluid reservoir 286 contains a fluid heat transfer fluid as previously described. A pump 138 is provided inline with pipe or tube 288 to circulate the heat transfer fluid from the fluid heat exchanger 130 to the fluid reservoir 286 and back to the fluid heat exchanger. The outlet 282 of the fluid heat exchanger 274 attached to the hot portion 28 of the Stirling cooler 274 is connected to a radiator coil 300 by a pipe or tube 302; the radiator coil is connected to the inlet 280 of the fluid heat exchanger by a pipe or tube 304. The radiator coil 300 contains a fluid heat transfer fluid as previously described. A pump 284 is provided inline with pipe or tube 302 to circulate the heat transfer fluid from the fluid heat exchanger 274 to the radiator coil 300 and back to the fluid heat exchanger. An electric fan 306 is provided adjacent the radiator coil 300 to blow air across the radiator coil.

The fluid reservoir 286 is connected to a balloon-like, inner container-contacting annular collar 308 that is fillable with the heat transfer fluid from the fluid reservoir by a pipe or tube 310. The collar 308 is connected to the fluid reservoir by a pipe or tube 312. A pump 314 is provided inline with the pipe or tube 310 selectively fills the collar 308 with the heat transfer fluid from the fluid reservoir 286 and circulates the heat transfer fluid from the fluid reservoir through the pipe or tube 310 to the collar, through the pipe or tube 312 and back to the fluid reservoir. The collar 308 is made from a flexible plastic, such as polyethylene, polypropylene and the like, and includes a plurality of ribbed sections. The collar 308 is sufficiently flexible so that it can conform to the shape of a container 322 and contact the outer surface of a container positioned within the collar.

The inner collar 308 is disposed inside an annular, inflatable outer collar 316. An electric fluid pump 318 is connected to the outer collar 316 by a pipe or tube 320. The pump 318 is selectively operable to inflate or deflate the outer collar 316 with a fluid, such as air. The inner collar 308 and outer collar 316 are designed such that when the outer collar is inflated, the outer collar pushes the inner collar into close, intimate contact with the outer surface of a container 322; and when the outer collar is not inflated, or not fully inflated, the inner collar permits the container received within the inner collar to be removed therefrom.

A container transport mechanism 324 is provided adjacent the end of the cylindrical body 252 containing the collars 308, 316 for selectively positioning the container 322, such as a beverage container, within the annular inner collar 308 and removing the container therefrom.

The container rapid chilling apparatus 250 operates as follows. When the Stirling cooler 272 is operating, heat from the heat transfer fluid in the fluid heat exchanger 130 is transferred to the cold portion 26 of the Stirling cooler. The cooled heat transfer fluid in the fluid heat exchanger 130 is then pumped to the fluid reservoir 286 through the pipe or tube 288. The heat transfer fluid in the fluid reservoir 286 circulates back to the fluid heat exchanger 130 through the pipe or tube 290. Thus, the heat transfer fluid in the fluid reservoir is continuously cooled by the Stirling cooler 272 until the fluid in the reservoir reaches a desired temperature. Temperature sensors (not shown) and a control circuit (not shown) regulate the operation of the Stirling cooler 272 and the pump 138 so that the heat transfer fluid in the fluid reservoir 286 is maintained at the desired temperature.

The temperature of the heat transfer fluid in the fluid reservoir 286 should be sufficiently low so that it can remove heat sufficiently rapidly from the container 322 and the contents thereof that are at ambient temperatures so as to achieve a desired contents temperature within a desired amount of time. Generally, the heat transfer fluid in the fluid reservoir 286 should be maintained at a temperature between approximately 0° and −100° F.; preferably, between approximately −30° and −60° F.; especially, approximately −50° F. Heat transfer fluids suitable for operation at such low temperatures are well known to those skilled in the art, and include alcohols, such as methanol and propanol and other appropriate low temperature working fluids. Desired temperatures for the contents of the container 322 depend on the nature of the contents and their intended use. For example, for a cold beverage, such as Coca-Cola®, the desired temperature is generally between approximately 32° and 40° F.

Operation of the Stirling cooler 272 transfers heat from the cold portion 26 to the hot portion 28. Heat at the hot portion 28 is then transferred to the heat transfer fluid in the fluid heat exchanger 274. The heated heat transfer fluid in the heat exchanger 274 is then circulated through the radiator coil 300 by the pump 284. The fan 306 moves air at ambient temperature across the radiator coil 300 and heat from the heat transfer fluid is transferred to the moving air. The cooled heat transfer fluid is then returned to the fluid heat exchanger 274 through the pipe or tube 304 where the cycle begins again.

When it is desired to rapidly chill a container 322, the container is placed in the transport mechanism 324 and the transport mechanism is pushed into the body 254 of the apparatus 250. By so doing, the container 322 is positioned within the annular inner collar 308. Since the outer collar 316 is not inflated, the container can be easily inserted within the inner collar 308. Although there may be some contact between the inner collar 308 and the container 322 when it is inserted therein, the inner collar is not in close intimate contact with the container such that it will conform to the shape of the container.

After the container 322 is positioned within the inner collar 308, the pump 314 circulates the heat transfer fluid from the fluid reservoir 286 through the inner collar 308. At the same time, the pump 318 pumps a fluid, such as air, into the outer collar 316. Inflation of the outer collar 316 causes the outer collar to push inwardly on the inner collar 308; thus, pushing the inner collar into intimate contact with the container 322 received therein. The pressure exerted on the inner collar 308 by the outer collar 316 causes the flexible inner collar to assume that shape of the container 322 received therein.

As the heat transfer fluid from the fluid reservoir 286 circulates through the inner collar 308 heat from the container 322, and the contents thereof, is transferred to the heat transfer fluid in the inner collar. Since there is a reservoir 286 of cold heat transfer fluid, there is a relatively large capacity for absorbing heat rapidly from the container 322 and its contents. Since the heat transfer from the container 322 to the heat transfer fluid in the inner collar 308 may be so rapid, the contents of the container adjacent the walls of the container may freeze depending on the nature of those contents. In the case of carbonated beverages, freezing may cause foaming of the beverage when it is opened, and, therefore, is undesirable. Accordingly, it may be desirable to rotate the container 322 back and forth during the rapid cooling so that the contents of the container are slightly agitated or mixed. Typically, a beverage container will include a relatively small air bubble within the container. Rotating the container causes the bubble to slide across the inside walls of the container. It is the movement of the bubble along the walls that keeps ice from forming inside the container by displacing liquid adjacent the wall of the container. This relatively gentle mixing of the contents of the container permits the warmer portion of the contents not adjacent the walls of the container to move toward the walls thereby improving the heat transfer from the contents, and thereby avoiding freezing of the contents.

In order to rotate the container 322 back and forth, the motor 266 is actuated. The motor 266 rotatably drives the gear 270 through the chain 268. The teeth of the gear 270 mesh with the teeth of the track 258 and cause the body 254 of the apparatus 250 to rotate about the longitudinal axis of the body. The motor 266 first drives the gear 270 in one direction and then reverses and drives the gear in the opposite direction. This causes the body 254 of the apparatus 250 to rotate in one direction and then rotate in the opposite direction. Depending on the nature of the contents of the container 322, more or less rotation of the container may be necessary to achieve sufficient mixing of the contents to achieve the desired amount of heat transfer within the desired amount of time and to avoid freezing of the contents. Again, for a beverage product, such as Coca-Cola®, that has a relatively small air bubble within the container and the contents are primarily water, the body 254 of the apparatus 250 should be rotated through an angle of between approximately 180° and 300°; preferably, approximately 270°. Control circuitry (not shown) is provided to control the operation of the motor 266 to achieve the desired amount and frequency of rotation.

Since the heat transfer fluid in the inner collar 308 is so cold and the heat transfer from the container 322 is so rapid, frost may develop on the outside of the container as the result of condensation and freezing of water vapor in the ambient air. Such is not viewed as a disadvantage of the present invention, and, in fact, is considered desirable from a consumer viewpoint.

After the desired amount of heat has been withdrawn from the container 322 and its contents, usually by either timing the cooling operation or by measuring the temperature differential between the heat transfer fluid entering and exiting the inner collar 308, the outer collar 316 is deflated by turning off the pump 318 or by reversing the pump to withdraw air from the outer collar. The deflation of the outer collar 316 releases the pressure exerted on the inner collar 308 by the outer collar, thereby releasing the container from intimate contact with the inner collar. This absence of intimate contact of the container 322 by the inner collar 308 permits the container to be easily withdrawn from within the inner collar. This can be done by pulling the container transport mechanism 324 out of the body 254 of the apparatus 250. The container 322 and its contents are then ready for use, such as drinking an ice cold beverage.

As described above, under certain conditions, frost may form on the container. Therefore, it is specifically contemplated that the inner collar 308 may be embossed (not shown) with a trademark, a logo, or other design or indicia that will cause the frost that forms on the outside of the bottle to bear the embossed pattern. The embossed trademark, logo, design or indicia on the inner collar 308 will therefore be printed on the outside of the container in frost.

Although the present invention has been illustrated as being a self-contained unit, it is specifically contemplated that rapid chill apparatus can be incorporated in other devices, such as vending machines, container dispensers and the like.

With reference to FIG. 16, there is shown a quick chill apparatus for dispensing a fluid, such as a beverage dispenser. The apparatus comprises a Stirling cooler 324 of the type shown in FIG. 1. The cold portion 26 of the Stirling cooler 324 is provided with a fluid heat exchanger 130 (FIG. 1); the hot portion 28 of the Stirling cooler is provided with a metal heat sink 350 of the type shown in FIGS. 3 and 4. The outlet 136 (FIG. 1) of the fluid heat exchanger 130 attached to the cold portion 26 of the Stirling cooler 324 is connected to a fluid reservoir 326 by a pipe or tube 328 (FIG. 16); the fluid reservoir is connected to the inlet 134 of the fluid heat exchanger by a pipe or tube 330. The fluid reservoir 326 contains a heat transfer fluid as previously described. A pump 332 is provided inline with the pipe or tube 328 to circulate the heat transfer fluid from the fluid heat exchanger 130 to the fluid reservoir 326 and back to the fluid heat exchanger.

The fluid reservoir 326 is connected to a solid heat exchanger 334 by a pipe or tube 336. Although the heat exchanger 334 is illustrated as being a solid heat exchanger, it is specifically contemplated that the heat exchanger can be a fluid heat exchanger. A pump 338 is provided inline with the pipe or tube 336 to circulate the heat transfer fluid from the fluid reservoir 326 through the heat exchanger 334 and back to the fluid reservoir. The heat exchanger 334 is made from a heat-conducting material, such as aluminum. The portion of the pipe or tube 336 within the heat exchanger is made from a heat-conducting material so that heat from the heat exchanger can be transferred to the heat transfer fluid flowing in the pipe 336. The portion of the pipe or tube 336 disposed within the heat exchanger 334 is also disposed in a serpentine pattern so that the path length of the pipe or tube, and, therefore, the residence time of the heat transfer fluid flowing in the pipe or tube within the heat exchanger is increased, thus increasing the opportunity for heat transfer.

A pipe or tube 340 is connected at one end to a source of a fluid to be chilled 342, such as a pressurized source of water or carbonated water. The other end of the pipe or tube 340 is connected to the heat exchanger 334. The portion of the pipe or tube 340 within the heat exchanger 334 is made from a heat-conducting material so that heat from the fluid to be chilled flowing in the pipe or tube 340 can be transferred to the heat exchanger and ultimately to the heat transfer fluid flowing in the pipe or tube 336. The portion of the pipe or tube 340 disposed within the heat exchanger 334 is also in a serpentine pattern so that the path length of the pipe or tube, and, therefore, the residence time of the fluid to be chilled flowing in the pipe or tube within the heat exchanger, is increased, thus increasing the opportunity for heat transfer.

Sensors 342, 344 are provided in the fluid reservoir 326 and in the heat exchanger 344, respectively, and are connected by an electric circuit to a controller 346. The pumps 332, 338 and the Stirling cooler 324 are also connected by an electric circuit to the controller 346. The controller 346 controls the operation of the Stirling cooler 324 and the pump 332 so that the heat transfer fluid in the fluid reservoir 326 is maintained at a desired temperature. Generally, the heat transfer fluid in the fluid reservoir 342 should be maintained at a temperature between approximately 0° and −100° F.; preferably, between approximately −30° and −60° F.; especially, approximately −50° F. Heat transfer fluids suitable for operation at such low temperatures are well known to those skilled in the art, and include alcohols, such as methanol and propanol and other appropriate low temperature working fluids. The controller 346 also operates the pump 338 so that a sufficient amount of cold heat transfer fluid in the fluid reservoir 326 is circulated through the heat exchanger 334 so that the heat exchanger is maintained at a desired temperature.

When it is desired to dispense a chilled fluid from the apparatus, a valve 348 on the pipe or tube 340 is opened so that the fluid to be chilled flows from the source 342, through the heat exchanger 334 and is then dispensed into a receiving container (not shown), such as a cup. Heat from the fluid flowing in the portion of the pipe or tube 340 within the heat exchanger 334 is transferred to the material from which the heat exchanger is made, such as to the aluminum metal. The heat in the material from which the heat exchanger 334 is made is then transferred to the heat transfer fluid flowing in the portion of the pipe or tube 336 within the heat exchanger. The warmed heat exchange fluid flows from the heat exchanger 334 to the fluid reservoir 326 through the pipe or tube 336. The heat exchange fluid contained in the fluid reservoir 326 is then pumped to the fluid heat exchanger 130 attached to the cold portion 26 of the Stirling cooler 324. The warmed heat transfer fluid in the fluid heat exchanger 130 transfers its heat to the cold portion 26 of the Stirling cooler 324. Through the operation of the Stirling cooler 324, heat is transferred from the cold portion 26 to the hot portion 28. Heat from the hot portion 28 is then transferred to the radiator 350. Heat from the radiator 350 is transferred to the air surrounding the radiator.

With reference to FIG. 17, there is shown a transportable container dispenser 352. The dispenser 352 comprises an exterior case 354 (shown in dotted). The shape of the case 354 is not critical to the present invention and can be any size and shape necessary to accommodate the internal mechanism and is also pleasing to the eye. Furthermore, the case 354 must be sized and shaped so as to be transportable in a vehicle (not shown), such as a car, a taxi cab, a bus, a train, a boat, an airplane, or the like.

Inside the case 354 is a pair of spaced plates 356, 358. The plates 356, 358 define a dispensing path 360. A plurality of containers 362 are stacked in the dispensing path 360. The plates 356, 358 are arranged in a serpentine manner so that at least a portion of the dispensing path 360 is serpentine in shape. Although the present invention is illustrated as having a serpentine dispensing path, the particular shape of the dispensing path is not critical to the present invention. As previously described for other embodiments above, such as the vending machines shown in FIGS. 2 and 4, the dispensing path can be vertically straight or it can be straight slanted. The purpose of the dispensing path is to provide storage for as many containers 362 as can be accommodated by the space provided within the case 354. The walls of the case 354 include insulation (not shown) so that heat transfer from the surroundings outside the case to the inside of the case is minimized.

The dispensing path 360 includes a dispensing end 364 located adjacent the bottom of the dispensing path. Doors 366 are provided in the case 354 adjacent the end 364 of the dispensing path 360 so that containers 362 at the end of the dispensing path can be manually retrieved from inside the case.

At least a portion of the dispensing path 360 adjacent the end 364 thereof is defined by a plate 368. The plate 368 is made from a heat-conducting material, such as aluminum. At least a portion of the containers 362 contact the plate 368 while in the portion of the dispensing path adjacent the end 364 thereof. Thus, at least a portion of each container 362 is in contact heat exchange relationship with the plate 368 immediately prior to being dispensed through the door 366.

The plate 368 is connected in heat exchange relationship with the cold portion 26 of a Stirling cooler 370 of the type shown in FIG. 1 by a member 372. The member 372 is made from a heat-conducting material, such as aluminum. Therefore, heat from the plate 368 flows through the member 372 to the cold portion 26 of the Stirling cooler 370. By operation of the Stirling cooler 370, heat from the cold portion 26 is transferred to the hot portion 28. The hot portion 28 of the Stirling cooler 370 is connected to a radiator 374 of the type shown in FIGS. 3 and 4. The radiator 374 is made from a heat-conducting material, such as aluminum. The radiator 374 also includes a plurality of fins 376 so as to increase the surface area of the radiator that is exposed to the surrounding air. Vents (not shown) are provided in the case 354 to permit air outside the case to circulate through the area adjacent the radiator 374. A fan (not shown) may also be included adjacent the radiator 374 to facilitate the movement of air across the radiator to thereby increase the amount of heat transferred from the radiator to the surrounding air. A layer of insulation (not shown) is also provided between the radiator 374 and the hot portion 28 of the Stirling cooler 370 and the cold portion 26 of the Stirling cooler, the member 372 and the plate 368.

The Stirling cooler 370 is connected by an electrical circuit (not shown) to a controller (not shown) that is also connected by an electrical circuit (not shown) to a sensor (not shown) within the insulated enclosure defined by the case 354 and the layer of insulation (not shown). The controller (not shown) regulates the operation of the Stirling cooler 370 so that a desired temperature is maintained within the insulated enclosure.

The transportable container dispenser 352 is operated by placing a plurality of containers 362 in the dispensing path 360. The Stirling cooler 370 is connected by an electrical circuit (not shown) to the electrical system of a vehicle (not shown) in which the dispenser is to be transported. It is intended that the Stirling cooler 370 is designed so that it can operate not only from the vehicle's electrical system when the vehicle's motor is running, but that the Stirling cooler has a sufficiently low current demand that the Stirling cooler can operate only from the vehicle's battery overnight without depleting the vehicle's battery of sufficient power to start the vehicle.

With containers 362 stacked in the dispensing path 360, those containers adjacent the end 364 of the dispensing path are in metal-to-metal contact with the plate 368. This contact permits heat in the containers 362, and the contents thereof, to be transferred to the plate 368. Heat from the air surrounding the plate 362 is also transferred to the plate. The heat from the plate 362 is then transferred to the cold portion 26 of the Stirling cooler 370 through the member 372. The Stirling cooler 370 transfers the heat from the cold portion 26 to the hot portion 28, and, then, to the radiator 374. Heat from the radiator 374 is transferred to the surrounding air. The result is that the containers 362 are cooled to a desired temperature.

Figure 18:
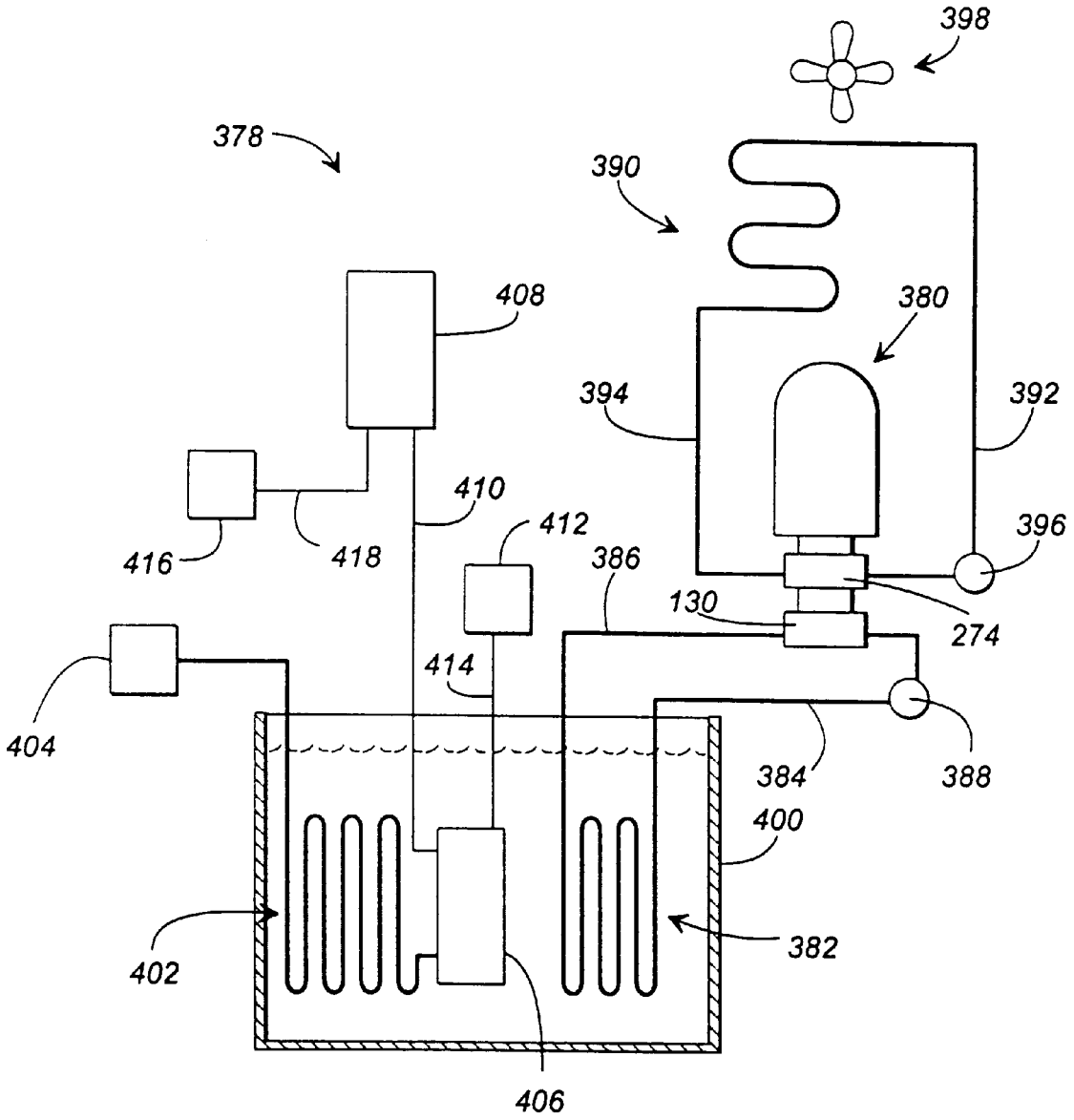
FIG. 18 is an exploded perspective view of a disclosed embodiment of a beverage dispensing apparatus in accordance with the present invention.

With reference to FIG. 18, there is shown a schematic diagram of a fluid dispenser 378, such as a cold beverage dispenser. The dispenser 378 comprises a Stirling cooler 380 of the type shown in FIG. 1 having a cold portion 26 provided with a fluid heat exchanger 130 (FIG. 1). Attached to the hot portion 28 of the Stirling cooler 378 is a fluid heat exchanger 274 (FIG. 1). The outlet 136 of the fluid heat exchanger 130 attached to the cold portion 26 of the Stirling cooler 380 is connected to a heat exchanger coil 382 by a pipe or tube 384; the heat exchanger coil is connected to the inlet 134 of the fluid heat exchanger by a pipe or tube 386. The heat exchange coil 382 is made from a heat-conducting material, such as copper. The heat exchange coil 382 contains a heat transfer fluid, as previously described. A pump 388 is provided inline with the pipe or tube 384 to circulate the heat transfer fluid from the fluid heat exchanger 130 to the heat exchange coil 382 and back to the fluid heat exchanger through the pipe or tube 386.

The outlet 282 of the fluid heat exchanger 274 attached to the hot portion 28 of the Stirling cooler 380 is connected to a radiator coil 390 by a pipe or tube 392; the radiator coil is connected to the inlet 280 of the fluid heat exchanger by a pipe or tube 394. The radiator coil 390 is made from a heat-conducting material, such as copper. The radiator coil 390 contains a heat transfer fluid, as previously described. A pump 396 is provided inline with pipe or tube 392 to circulate the heat transfer fluid from the fluid heat exchanger 274 to the radiator coil 390 and back to the fluid heat exchanger through the pipe or tube 394. An electric fan 398 is provided adjacent the radiator coil 390 to blow air across the radiator coil.

The heat exchange coil 382 is disposed inside a fluid container 400. The fluid container 400 contains a heat transfer fluid, such as water. Also disposed within the fluid container 400 is a heat exchange coil 402. One end of the heat exchange coil 402 is connected to a source of a fluid 404 to be chilled and dispensed, such as water. The source of fluid 404 is under pressure. The other end of the heat exchange coil 402 is connected to the fluid inlet of a carbonator 406. The fluid outlet of the carbonator is connected to a fluid dispensing head 408 by a pipe or tube 410. A source of carbon dioxide gas 412 is connected to the gas inlet of the carbonator 406 by a pipe or tube 414. A source of flavored beverage syrup 416 is connected to the dispensing head 408 by a pipe or tube 418. Syrup from the pipe or tube 418 is mixed with chilled carbonated water from the pipe or tube 410 in the dispensing head 408 to form the finished beverage. The dispensing head 408 also controls dispensing of the beverage into a beverage container (not shown), such as a cup.

A controller (not shown) is connected by an electric circuit (not shown) to a sensor (not shown) within the fluid container 400. The controller (not shown) is also connected by an electric circuit (not shown) to the Stirling cooler 380 and the pumps 388 and 396. The controller regulates the operation of the Stirling cooler 380 and the pumps 388, 396 so that sufficient heat transfer fluid flows through the heat exchange coil 382 to cool the fluid in the fluid container 400 to a desired temperature and so that sufficient heat transfer fluid flows through the radiator coil 390 to dissipate the heat transferred to the hot portion 28 of the Stirling cooler.

When it is desired to dispense a chilled beverage from the dispenser 378, the dispenser head is actuated so as to open appropriate valves to permit the pressurized water to flow through the dispenser and be dispensed into a receiving container (not shown). Thus, the actuation of the dispenser head 408 allows water from the source 404 to flow through the heat exchange coil 402. The heat from the water flowing through the heat exchange coil 402 is transferred to the heat transfer fluid contained in the fluid container 400. Heat from the heat transfer fluid in the fluid container 400 is transferred to the heat transfer fluid flowing through the heat exchange coil 382. The heat transfer fluid flowing through the heat exchange coil 382 returns to the fluid heat exchanger 130 and transfers its heat to the cold portion 26 of the Stirling cooler 380. The Stirling cooler transfers the heat from the cold portion 26 to the hot portion 28. Heat from the hot portion 28 of the Stirling cooler 380 is transferred to the heat transfer fluid flowing through the fluid heat exchanger 274. The heat transfer fluid in the fluid heat exchanger 274 is pumped to the radiator coil 390 and transfers its heat to the air surrounding the radiator coil.

Carbon dioxide gas under pressure from the source 412 enters the carbonator 406 through the pipe or tube 414 and is dissolved in the chilled water from the heat exchange coil 402. The chilled carbonated water flows from the carbonator 406 to the dispenser head 408 through the pipe or tube 410. At the dispenser head 408, the carbonated water is mixed with flavored beverage syrup from the source 416 that flows from the pipe or tube 418. The chilled carbonated water with syrup mixed therewith is dispensed from the dispenser head 408 into a desired beverage-receiving container, such as a cup (not shown).

Figure 2:
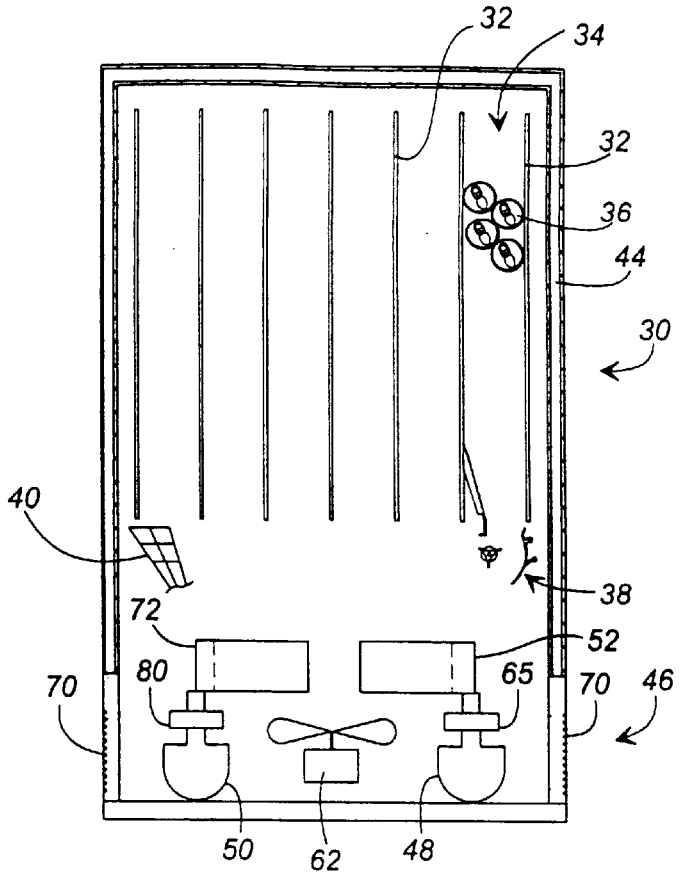
FIG. 2 is a front schematic view of a disclosed embodiment of a beverage vending machine in accordance with the present invention.
Figure 5:
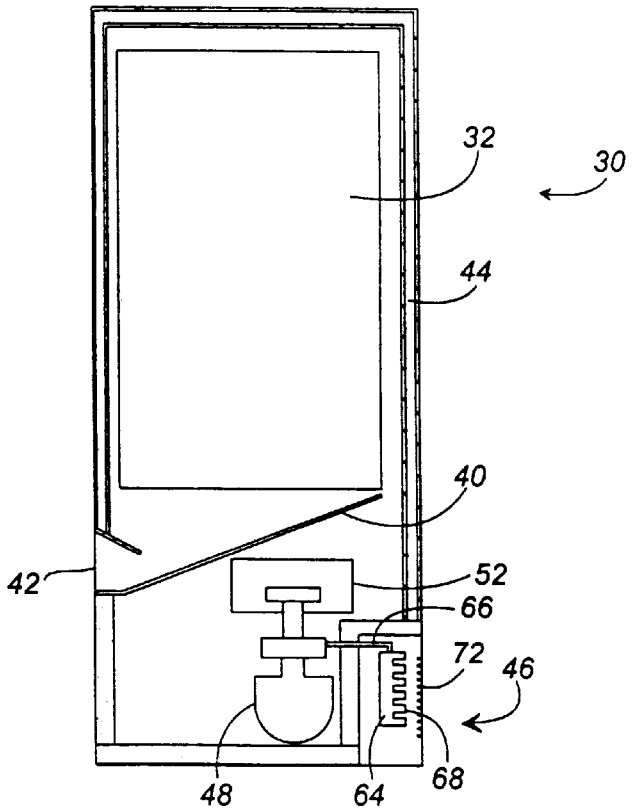
FIG. 5 is a side view of the beverage vending machine shown in FIG. 2.
Figure 19:
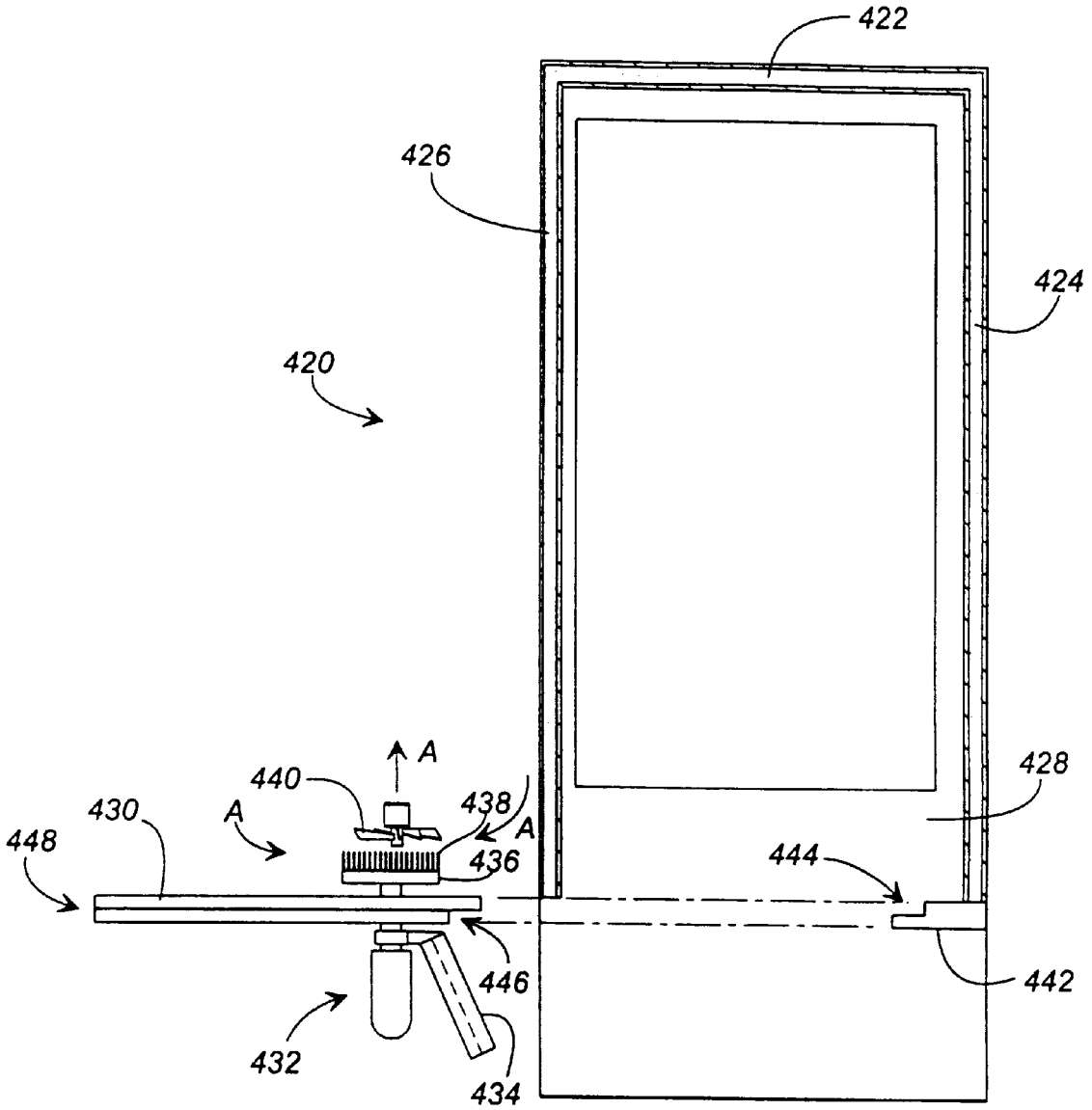
FIG. 19 is a schematic side view of an alternate disclosed embodiment of a vending machine in accordance with the present invention.

With reference to FIG. 19, there is shown a vending machine 420 similar to that shown in FIGS. 2 and 5. The vending machine 420 comprises an insulated enclosure defined by an insulated wall panels, including a top panel 422, a rear panel 424, a front panel 426, a left side panels 428, a right side panel (not shown) and a bottom panel 430. Mounted on the bottom insulated panel 430 is a Stirling cooler 432 of the type shown in FIG. 1. The Stirling cooler 432 includes a cold portion 26 and a hot portion 28 (FIG. 1). The Stirling cooler 432 is mounted on the insulating panel 430 such that the cold portion 26 is on one side of the panel; i.e., the top side, and the hot portion 28 is on the opposite side of the panel; i.e., the bottom side.

Connected to the hot portion 28 of the Stirling cooler 432 is a heat-conducting radiator 434 of the type shown in FIGS. 3, 4, 6, 8 and 16. Connected to the cold portion 26 of the Stirling cooler 432 is a plate 436. Formed on the upper surface of the plate 436 are a plurality of channels or fins 438 of the type shown in FIGS. 3 and 4.

Also mounted on the insulated panel 430 is an electric fan 440. The fan 440 is arranged so that it will move air in the direction shown by the arrows at A.

Mounted to the vending machine 420 at the bottom of the rear panel 424 is a partial insulated panel 442 that includes a notched portion 444. The bottom panel 430 also includes a notched portion 446 designed to mate with the notched portion 442 and support the rear portion of the bottom panel within the vending machine 420. The front portion 448 of the bottom panel 430 can then be removably fastened to the vending machine 420 by a latch mechanism (not shown) or other means of removably securing a panel as would be known to those skilled in the art. Thus, it will be appreciated that the bottom panel 430 including the Stirling cooler 432 can be relatively easily inserted into the vending machine 420 or removed therefrom.

Operation of the vending machine 420 will now be considered. Initially, the panel 430 is positioned in the bottom of the vending machine 420. Heat from the air surrounding the plate 436 is transferred to the plate. The fan 440 moves air across the plate so that warmer air is moved toward the plate from the sides and colder air adjacent the plate is moved upwardly toward the stacked beverage containers above. The plate 436 transfers heat to the cold portion 26 of the Stirling cooler 432. Operation of the Stirling cooler 432 transfers heat from the cold portion 26 to the hot portion 28. Heat from the hot portion 28 of the Stirling cooler 432 is transferred to the radiator 434 and then from the radiator to the surrounding air. A fan (not shown) can be used to move air across the radiator 434.

When the Stirling cooler 432 requires repair or ceases to operate properly, the entire module of the Stirling cooler, the insulated panel 430, and the fan 440 can be removed from the vending machine 420 and replaced with a similar module. The module can be removed by releasing the latch (not shown) or other retaining means attaching the front portion 448 of the panel 430 to the vending machine 420. The panel 430 can be slid forward until the notches 444, 446 disengage. The entire module, including the Stirling cooler 432, the radiator 434, the panel 430, the plate 436 and the fan 440 can be removed as a unit from the vending machine 420. Then, a similarly constructed module can be inserted into position at the bottom of the vending machine 420. This makes repair of the vending machine relatively quick and easy. The any needed repair to the Stirling cooler or components thereof can be performed at a remote location. By so doing, operation of the vending machine is not disrupted for a relatively long period of time while repairs are being made. Additionally, the level of expertise of the person performing the repair at the site of the vending machine 420 can be relatively low since actual repair of the Stirling cooler can be performed at the remote site by a skilled repair person.

Figure 20:
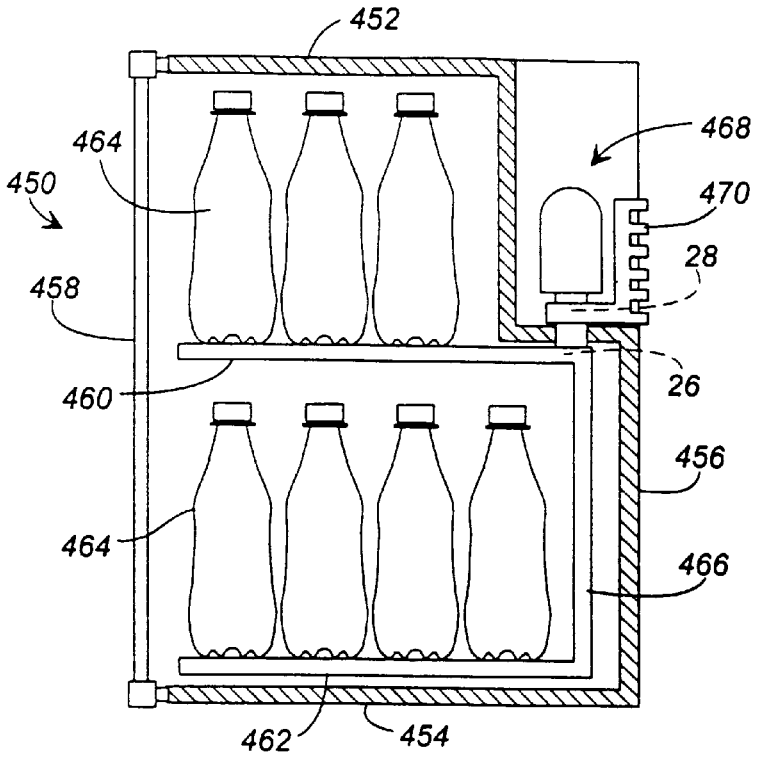
FIG. 20 is a schematic side view of an alternate disclosed embodiment of a glass door merchandiser in accordance with the present invention.

With reference to FIG. 20, it will be seen that there is a relatively small GDM 450. The GDM 450 includes an insulated enclosure defined by top and bottom insulated walls 452, 454, respectively, an insulated rear wall 456, insulated side walls (not shown) and an openable glass door 458 on the front thereof. Disposed inside the insulated enclosure is a pair of horizontal heat-conducting metal shelves 460, 462. The shelves 460, 462 can be made from a heat-conducting material, such as aluminum, and can be a solid piece of metal or can be fabricated as a wire rack. A plurality of containers 464 can be placed on the shelves 460, 462. The shelves 460, 462 are connected to each other by a vertically arranged heat-conducting plate 466. The plate 466 is made from a heat-conducting material, such as aluminum, and can be made from solid metal or can be fabricated as a wire rack.

A Stirling cooler 468 is disposed outside the insulated enclosure adjacent the rear insulated wall 456. The Stirling cooler 456 is of the type shown in FIG. 1 and includes a cold portion 26 and a hot portion 28. A portion of the Stirling cooler 468 extends through the rear insulated wall 456 such that the cold portion 26 is disposed inside the insulated enclosure and the hot portion 28 is disposed outside the insulated enclosure. The cold portion 26 of the Stirling cooler 26 is connected to the shelf 460 in a heat transfer relationship. Attached to the hot portion 28 of the Stirling cooler 468 is a radiator 470 of the type shown in FIGS. 3, 4, 6, 8, 16 and 19. The radiator 470 is made from a heat-conducting material, such as aluminum, and is connected to the hot portion 28 of the Stirling cooler 468 in a heat transfer relationship.

Operation of the GDM 450 will now be considered. Heat from the containers 464 disposed on the shelves 460, 462 is transferred to the shelves. Similarly, heat from the air surrounding the shelves 460, 462 is transferred to the shelves. Heat from the shelf 460 is transferred to the cold portion 26 of the Stirling cooler 468. Heat from the shelf 462 is transferred to the cold portion 26 of the Stirling cooler 468 through the heat-conducting plate 466. Operation of the Stirling cooler 468 transfers heat from the cold portion 26 to the hot portion 28. Heat from the hot portion 28 is transferred to the radiator 470, which then transfers heat to the air surrounding the radiator. The result is the containers 464 within the insulated enclosure of the GDM 450 are cooled to a desired temperature.

Figure 21:
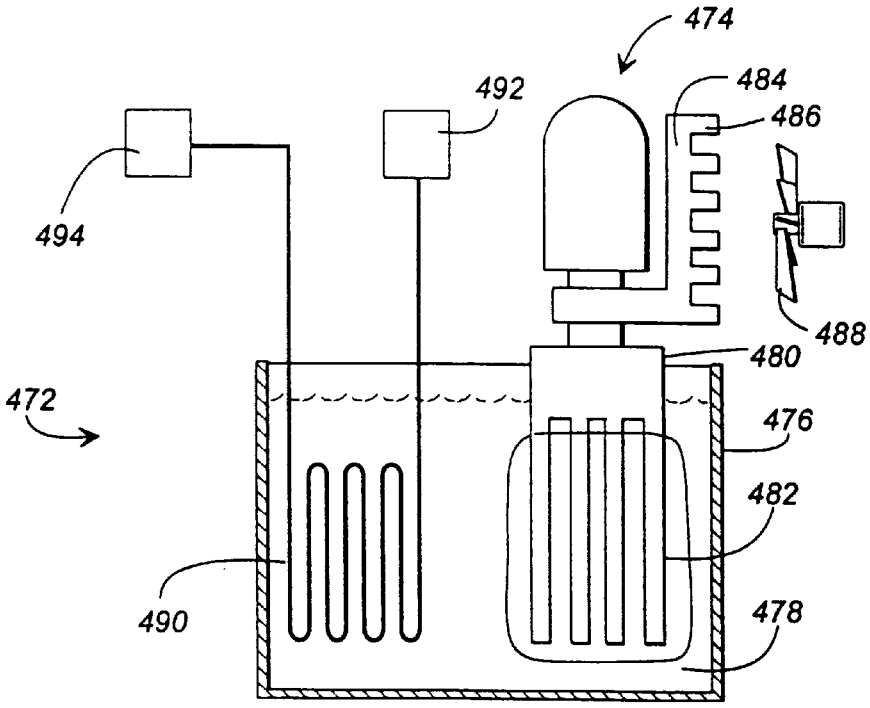
FIG. 21 is a partial schematic side view of an alternate disclosed embodiment of a beverage dispenser in accordance with the present invention.

With reference to FIG. 21, there is shown a post-mix beverage dispenser 472. The dispenser 472 comprises a Stirling cooler 474 of the type shown in FIG. 1 having a cold portion 26 and a hot portion 28. The Stirling cooler 474 is disposed adjacent a fluid container 476. The fluid container 476 contains a heat transfer fluid 478, such as water. Immersed in the heat transfer fluid 478 is a heat-conducting plate 480 that includes a plurality of fins 482. The plate 480 is made from a heat-conducting material, such as aluminum. The plate 480 is connected to the cold portion 26 of the Stirling cooler 474 in a heat transfer relationship. The hot portion 28 of the Stirling cooler 474 is connected to a radiator 484 of the type shown in FIGS. 3, 4, 6, 8, 16, 19 and 20. The radiator 484 is made from a heat-conducting material, such as aluminum, and is in a heat transfer relationship with the hot portion 28 and includes a plurality of fins 486. A fan 488 is disposed adjacent the radiator 484 to move air across the radiator.

Also immersed in the heat transfer fluid 478 in the fluid container 476 is a heat exchange coil 490. The heat exchange coil 490 is made from a heat-conducting material, such as copper, and is in heat transfer relationship with the heat transfer fluid 478. One end of the coil 490 is connected to a source of fluid to be cooled 492, such as a mixture of carbonated water and flavored syrup, such as Coca-Cola®, for fluid communication therewith. The source of fluid to be cooled 492 is under pressure so that it can be made to selectively flow through the coil 492. The other end of the coil 490 is connected to a dispenser valve 494 for fluid communication therewith. The dispenser valve 494 selectively dispenses cooled fluid therefrom in a manner well known in the art.

Operation of the dispenser 472 will now be considered. The dispenser valve 494 is activated so that fluid flows from the source of fluid to be cooled 492 to the dispenser valve and into a fluid receiving container, such as a cup (not shown). Heat from the fluid flowing through the coil 490 is transferred to the heat transfer fluid 478 in the fluid container 476 through the heat-conducting walls of the coil. Heat from the heat transfer fluid 478 is transferred to the cold portion 26 of the Stirling cooler 474 through the plate 480. Operation of the Stirling cooler 474 transfers heat from the cold portion 26 to the hot portion 28. Heat from the hot portion 28 is transferred to the radiator 484 and then to the air surrounding the radiator. The result is that the fluid flowing through the coil 490 to the dispenser valve 494 is cooled to a desired temperature.

Figure 22:
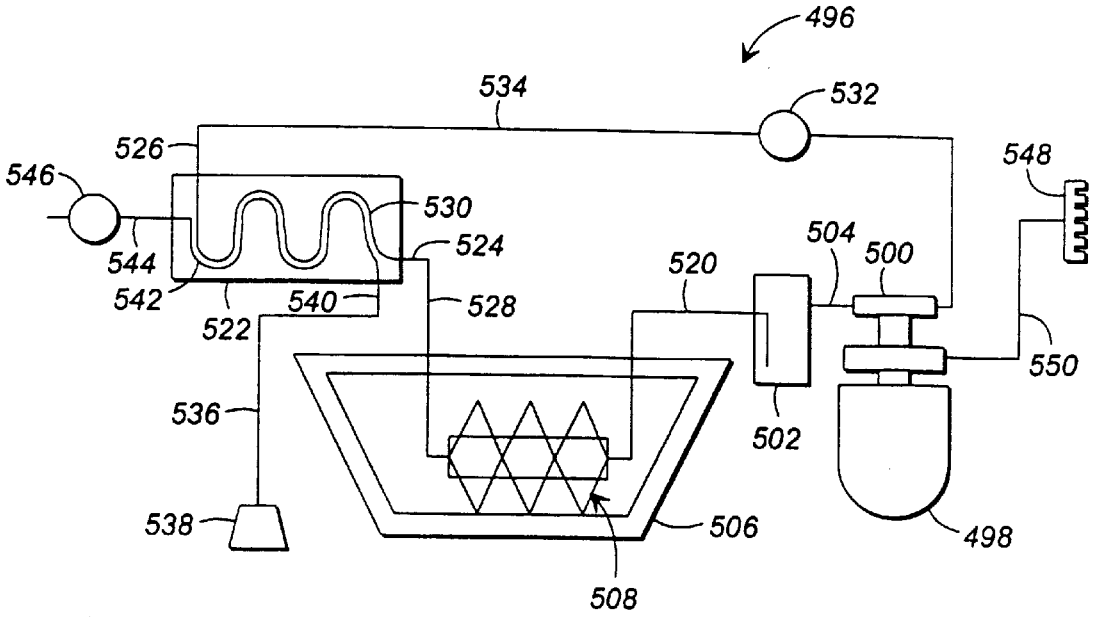
FIG. 22 is a schematic view of an alternate disclosed embodiment of a beverage dispenser in accordance with the present invention.
Figure 23:
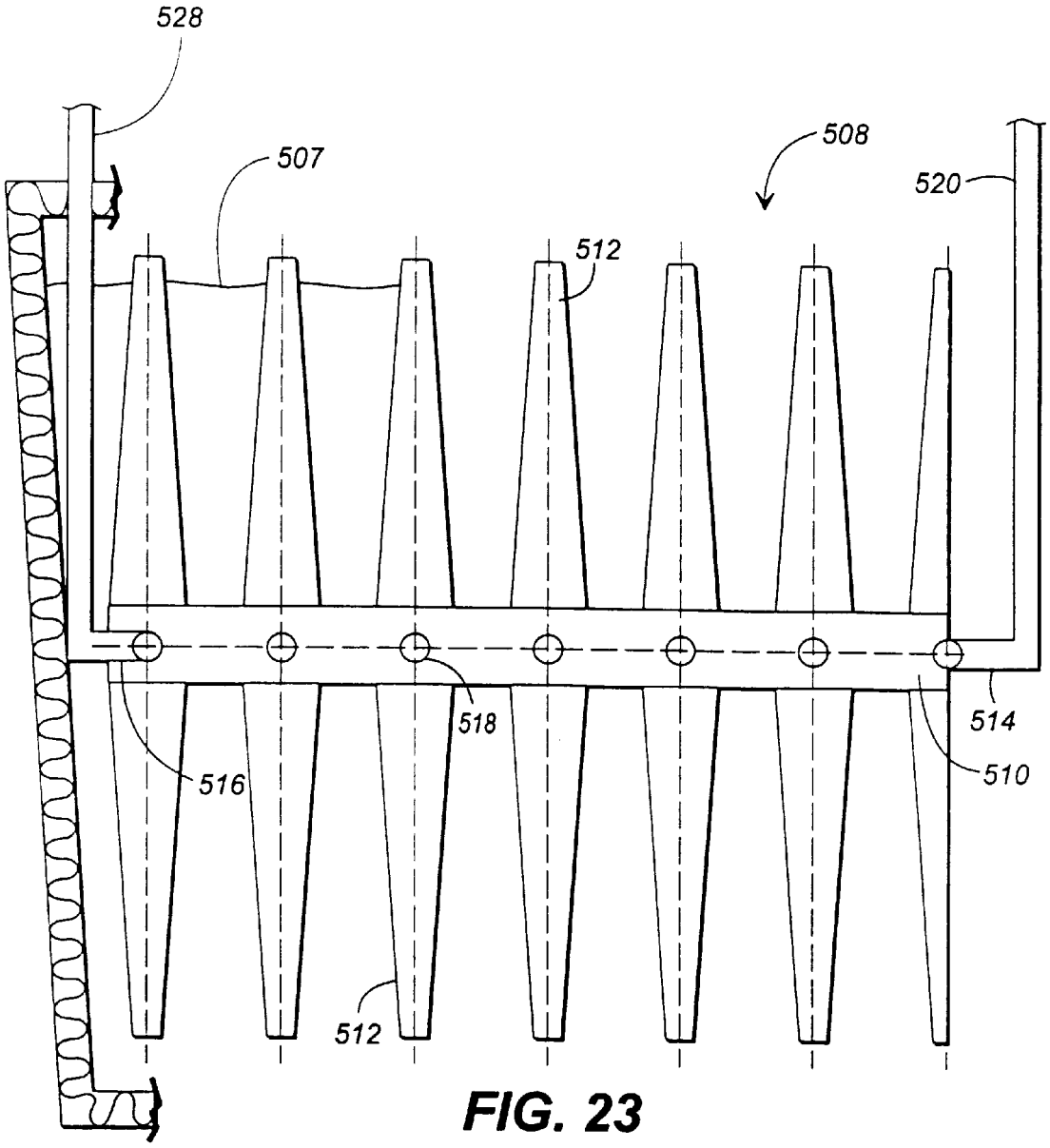
FIG. 23 is a partial cross-sectional view of the ice container shown in FIG. 22.
Figure 24:
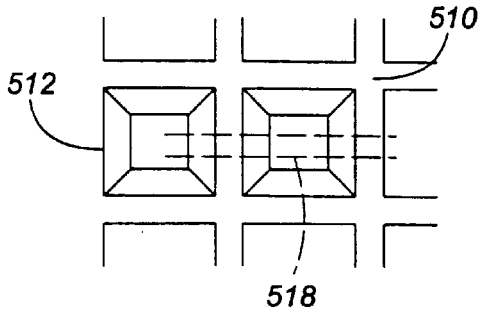
FIG. 24 is a partial detail top view of the heat exchange array shown in FIG. 22.

With reference to FIGS. 22–24, there is shown a post-mix beverage dispenser 496. The dispenser 496 comprises a Stirling cooler 498 of the type shown in FIG. 1 having a cold portion 26 and a hot portion 28. The cold portion 26 of the Stirling cooler 498 is provided with a fluid heat exchanger 500 of the type shown in FIG. 1. The Stirling cooler 498 is disposed adjacent a fluid reservoir 502. The outlet of the fluid heat exchanger 500 is connected to the inlet of the fluid reservoir 502 by a pipe or tube 504. The fluid reservoir 502 is designed to contain a heat transfer fluid suitable for operation at low temperatures. Suitable heat transfer fluids include alcohols, such as methanol and propanol.

Adjacent the fluid reservoir 502 is an insulated container 506. All walls of the container 506 include a heat insulating material. The container 506 is filled with water 507. Immersed in the water 507 in the container 506 is a heat exchange array 508 made from a heat conducting material, such as aluminum. The heat exchange array 508 comprises a central body member 510 and a plurality of fins 512 extending outwardly from the body member on the top and the bottom. Each fin 512 is in the shape of a truncated pyramid, with the base of the pyramid being attached to the central member 510 and the truncated portion of the pyramid being distal to the central member. The fins 512 are evenly spaced from each other in a plurality of rows and columns (FIG. 24). As can be seen in FIG. 23, the distance between adjacent fins 512 adjacent the central member 510 is less that the distance between the same adjacent fins at their distal ends. Thus, the space between adjacent fins 512 increases from a location proximate the central member 510 to a location distal to the central member.

A solid heat exchanger 522 defines a fluid inlet 524 and a fluid outlet 526. The fluid inlet 514 of the heat exchange array 508 is connected to the outlet of the fluid reservoir 502 by a pipe or tube 520. The outlet 516 of the heat exchange array 508 is connected to the solid heat exchanger 522 by a pipe or tube 528. Although the heat exchanger 522 is illustrated as being a solid heat exchanger, it is specifically contemplated that the heat exchanger can be a fluid heat exchanger. The solid heat exchanger 522 is made from a heat-conducting material, such as aluminum.

The solid heat exchanger 522 also defines a sinusoidal fluid path 530 that extends from the fluid inlet 524 to the fluid outlet 526. A pump 532 is provided inline with a pipe or tube 534 that connects the outlet 526 of the solid heat exchanger 522 to the inlet of the fluid heat exchanger 500. The pump 532 is provided to circulate the heat transfer fluid from the fluid heat exchanger 500 to the fluid reservoir 502 through the heat exchange array 508, through the solid heat exchanger 522 and back to the fluid heat exchanger 500 on the cold portion 26 of the Stirling cooler 498.

A pipe or tube 536 is connected at one end to a source of a fluid to be chilled 538, such as a pressurized source of a mixture of carbonated water and flavored syrup, such as Coca-Cola®. The other end of the pipe or tube 536 is connected to an inlet 540 to the solid heat exchanger 522. The solid heat exchanger 522 also defines a second fluid path 542 that extends from the fluid inlet 540 to a fluid outlet 544. A dispenser valve 546 is provided on the fluid outlet 544 of the solid heat exchanger 522. The dispenser valve 546 selectively dispenses cooled fluid therefrom in a manner well known in the art.

The hot portion 28 of the Stirling cooler 498 is connected to a radiator 548 of the type shown in FIGS. 3, 4, 6, 8, 16, 19 and 20 by a heat pipe 550. The radiator 548 is made from a heat-conducting material, such as aluminum, and is in a heat transfer relationship with the hot portion 28 and includes a plurality of fins. A fan (not shown) may be disposed adjacent the radiator 548 to move air across the radiator.

Suitable sensors, controllers and electric circuits (all not shown) are provided to control the operation of the Stirling cooler 498, and the pump 532 to provide a desired level of cooling of the solid heat exchanger 522.

Operation of the dispenser 496 will now be considered. Operation of the Stirling cooler 498 causes heat to be extracted from the heat exchange fluid contained in the fluid heat exchanger 500. Operation of the pump 532 causes the cooled heat exchange fluid in the fluid heat exchanger 500 to flow to the fluid reservoir 502. The reservoir 502 provides a supply of cooled heat transfer fluid for the fluctuating fluid flow demands of the system. The heat exchange fluid then flows from the reservoir 502 to the heat exchange array 508. Heat from the water 507 contained in the container 506 and surrounding the heat exchange array 508 flows into the fins 512, to the central member 510 and then to the heat exchange fluid contained in the fluid path 518. It is specifically contemplated that enough heat should be transferred from the water 507 in the container 506 to the heat transfer fluid flowing through the heat exchange array 508 such that a portion of the water, preferably substantially all of the water, is converted to ice. The shape of the fins 512 that make up the heat exchange array 508 is specifically designed to accommodate expansion of the water as it freezes. Due to the tapered shape of the fins 512, the expansion of the ice as it freezes will not place excessive pressure or stress on the fins, thus avoiding fracture or breakage of the fins. Furthermore, since the amount of heat necessary to produce a phase change of water from solid to liquid is relatively large, the block of ice surrounding the heat exchange array 508 provides a relatively large heat sink for the heat transfer fluid flowing therethrough.

The heat transfer fluid in the heat exchange array 508 then flows to the solid heat exchanger 522. When the valve 546 is actuated, fluid to be chilled flows from the source 538 through the fluid path 542 in the solid heat exchanger 522. Heat from the fluid flowing in the fluid path 542 is transferred to the solid heat exchanger 522 and then to the heat exchange fluid flowing through the fluid path 530 in the solid heat exchanger. The heated heat exchange fluid flowing through the fluid path 530 then flows to the fluid heat exchanger 500. Heat from the heat transfer fluid flowing through the fluid heat exchanger 500 is then transferred to the cold portion 26 of the Stirling cooler 498. Operation of the Stirling cooler 498 causes the heat to be transferred from the cold portion 26 to the hot portion 28. Heat from the hot portion 28 of the Stirling cooler 498 is then transferred to the radiator 548 through the heat pipe 550 where the heat is then transferred to the surrounding air.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. A container dispensing apparatus comprising:

an insulated enclosure, said insulated enclosure having an outside and an inside;

means disposed inside said enclosure for defining a path for receiving a plurality of containers in stacked relationship and for dispensing individual containers therefrom;

heat-conducting means associated with said path means such that at least a portion of each container stacked in said path contacts said heat-conducting means before each said container is dispensed from said path means;

a Stirling cooler disposed outside said enclosure, said Stirling cooler having a hot portion and a cold portion; and at least one heat pipe connected to said cold portion and to said heat-conducting means.

2. A container dispensing apparatus comprising:

an insulated enclosure, said enclosure having an outside and an inside and a door for accessing containers contained in said enclosure;

at least one heat-conducting shelf disposed inside said enclosure for supporting a plurality of containers thereon;

a Stirling cooler disposed outside said enclosure, said Stirling cooler having a hot portion and a cold portion; and one end of at least one heat pipe being connected to said cold portion and said other end being connected to said heat-conducting shelf.

3. A method comprising operating a Stirling cooler having a hot portion and a cold portion, said Stirling cooler positioned outside an insulated enclosure, said cold portion being connected to one end of a heat pipe and said other end of said heat pipe being connected to a heat-conducting member inside said insulated enclosure, such that heat from said heat-conducting member is transferred to said cold portion of said Stirling cooler through said heat pipe.

4. The apparatus of claim 2, wherein said heat pipe comprises an evaporative end attached to said heat-conducting shelf.

5. The apparatus of claim 2, wherein said heat pipe comprises a condensing end in communication with said cold portion of said Stirling cooler so as to transfer heat from said heat-conducting shelf to said cold portion of said Stirling cooler.

6. The apparatus of claim 2, further comprising a plurality of containers positioned on said heat-conducting shelf.

7. The apparatus of claim 2, wherein said heat pipe comprises a bracket positioned therearound.

8. The apparatus of claim 7, wherein said bracket comprises a clamp positioned thereon, said clamp supporting said heat-conducting shelf.

9. The apparatus of claim 8, wherein said clamp is slidable along said bracket.

* * * * *